United States Patent [19]

Sakai et al.

[11] Patent Number: 5,047,314

[45] Date of Patent: Sep. 10, 1991

[54] SILVER HALIDE COLOR PHOTOGRAPHIC MATERIAL

[75] Inventors: Nobuo Sakai; Tsumoru Hirano, both of Kanagawa, Japan

[73] Assignee: Fuji Photo Film Co., Ltd., Kanagawa, Japan

[21] Appl. No.: 294,453

[22] Filed: Jan. 9, 1989

[30] Foreign Application Priority Data

Jan. 8, 1988 [JP] Japan ..... 63-1250

[51] Int. Cl.[5] ..... G03C 1/08; G03C 1/46; G03C 7/34

[52] U.S. Cl. ..... 430/505; 430/512; 430/545; 430/546; 430/551; 430/553

[58] Field of Search ..... 430/505, 512, 546, 551, 430/553, 545

[56] References Cited

U.S. PATENT DOCUMENTS

| | | | |
|---|---|---|---|
| 4,368,258 | 1/1983 | Fujiwhara et al. | 430/493 |
| 4,622,287 | 11/1986 | Umemoto et al. | 430/505 |
| 4,801,521 | 1/1989 | Ohki et al. | 430/380 |
| 4,820,614 | 4/1989 | Takada et al. | 430/505 |

FOREIGN PATENT DOCUMENTS

| | | |
|---|---|---|
| A0146337 | 6/1985 | European Pat. Off. , |
| A0159912 | 10/1985 | European Pat. Off. . |
| A0256531 | 2/1988 | European Pat. Off. . |
| 1516855 | 7/1978 | United Kingdom . |
| 2072365A | 9/1981 | United Kingdom . |
| 2171215A | 8/1986 | United Kingdom . |

*Primary Examiner*—Charles L. Bowers, Jr.
*Assistant Examiner*—Janet C. Baxter
*Attorney, Agent, or Firm*—Sughrue, Mion, Zinn, Macpeak & Seas

[57] ABSTRACT

A silver halide color photographic material comprising a support having thereon a cyan coupler-containing layer, a magenta coupler-containing layer and a yellow coupler-containing layer, wherein the cyan coupler-containing layer contains a dispersion of oleophilic fine particles which is obtained by emulsifying or dispersing a solution containing (a) at least one cyan coupler represented by the general formula (I) and/or (II) described below, (b) at least one compound represented by the general formula (III) described below and (c) at least one water-insoluble and organic solvent-soluble homopolymer or copolymer, (I)

(II)

wherein $R_1$, $R_2$, and $R_4$ each represents a substituted or unsubstituted aliphatic group, a substituted or unsubstituted aromatic group or a substituted or unsubstituted heterocyclic group, $R_3$, $R_5$ and $R_6$ each represents a hydrogen atom, a halogen atom, an aliphatic group, an aromatic group or an acylamino group, and $R_3$ may represent a non-metallic atomic group necessary to form a nitrogen-containing 5-membered or 6-membered ring together with $R_2$, $Y_1$ and $Y_2$ each represents a hydrogen atom or a group capable of being released upon a coupling reaction with an oxidation product of a developing agent, and n represents 0 or 1, (III)

wherein $R_7$, $R_8$, $R_9$, $R_{10}$ and $R_{11}$, which may be the same or different, each represents a hydrogen atom, a halogen atom, a nitro group, a hydroxy group, an alkyl group, an alkenyl group, an aryl group, an alkoxy group, an acyloxy group, an aryloxy group, an alkylthio group, an arylthio group, a mono- or di-aikylamino group, an acylamino group or a 5-membered or 6-membered heterocyclic group containing an oxygen atom or a nitrogen atom, and $R_{10}$ and $R_{11}$ may combine with each other to form a 5-membered or 6-membered aromatic ring.

The silver halide color photographic material exhibits excellent stability of coating solution therefor and provides cyan color image having improved fastness both to heat, to humidity and heat and to light.

41 Claims, No Drawings

SILVER HALIDE COLOR PHOTOGRAPHIC MATERIAL

FIELD OF THE INVENTION

The present invention relates to a silver halide color photographic material, and more particularly relates to a silver halide color photographic material with which heat and humidity fastness, heat fastness and light-fastness of the cyan color image formed therefrom are simultaneously improved and which exhibits dispersion stability.

BACKGROUND OF THE INVENTION

In order to form color photographic images, it is well known that an exposed photographic light-sensitive material having light-sensitive layers containing photographic couplers for three colors of yellow, magenta and cyan respectively is subjected to color development processing using a so-called color developing agent. In this process, a colored dye is formed upon a coupling reaction of a coupler with an oxidation product of an aromatic primary amine.

Color photographic images thus formed are required to show good preservability under various conditions. In order to satisfy this requirement, it is of importance that dyes used in forming each of the different hues show a slow color fading or discoloring rate and that the dyes show a discoloring rate as uniform as possible all over the image density region not to make the color balance of the remaining dye image unbalanced.

With conventional light-sensitive materials, particularly color papers, cyan dye images are seriously deteriorated by long-time dark fading due to the influence of humidity and heat and, hence, they are liable to undergo a change in color balance, thus a strong need has been felt that these materials be improved.

As hitherto known, there is the conflicting tendency with respect to cyan dye images that cyan images of less fading due to influence of humidity and heat show poor hue and remarkable fading due to influence of light and on the contrary, cyan images of less fading due to influence of light are liable to fade by influence of humidity and heat. Therefore, to develop a technique for simultaneously solving fading of cyan dye images due to influence of light, humidity and heat leads to remarkable improvement in not only preservability of cyan dye images but also preservability of balance of color images formed, thus the development of such a technique has been strongly desired.

In recent years, various kinds of improvements in techniques have been proposed in order to solve such problems. For instance, an improved technique using a coupler dispersing oil as described, for example, in JP-A-59-105645, JP-A-60-205447, JP-A-62-129853 and JP-A-62-196657 (the term "JP-A" as used herein means an "unexamined published Japanese patent application"), an improved technique involving a combination of couplers as described, for example, JP-A-60-221752, JP-A-60-221753, JP-A-60-242457, and JP-A-61-27540, an improved technique using a discoloration inhibitor as described, for example, in JP-A-60-222853, JP-A-62-87961, JP-A-62-118344, JP-A-62-178962, and JP-A-62-210465, and an improved technique using a combination of a coupler dispersing oil and a discoloration inhibitor as described, for example, in JP-A-61-167953, and JP-A-62-198859 have been proposed. However, these techniques are only partially effective or effective on a low level, and it can be seen that a satisfactory technique has not yet been developed.

SUMMARY OF THE INVENTION

Therefore, an object of the present invention is to provide a silver halide color photographic material which provides cyan dye images with which fading by influence of any of light, heat and humidity is prevented, and which exhibits dispersion stability.

Other objects of the present invention will become apparent from the following detailed description and examples.

As a result of extensive investigations on couplers and dispersion techniques therefor, it has been found by the present inventors that fading due to the influence of any of heat, humidity and light is prevented by means of dispersing specific cyan couplers described below using a water-insoluble and organic solvent-soluble homopolymer or copolymer.

Further, it has been found that the above-described effect for preventing color fading is more significantly enjoyed and superior dispersion stability is also achieved by adding a third component to the dispersion and thus resulting in the completion of the present invention.

More specifically, the above described objects of the present invention can be accomplished with a silver halide color photographic material comprising a support having thereon a cyan coupler-containing layer, a magenta coupler-containing layer and a yellow coupler-containing layer, wherein the cyan coupler-containing layer contains a dispersion of oleophilic fine particles which is obtained by emulsifying or dispersing a solution containing (a) at least one cyan coupler represented by the general formula (I) and/or (II) described below, (b) at least one compound represented by the general formula (III) described below and (c) at least one water-insoluble and organic solvent-soluble homopolymer or copolymer,

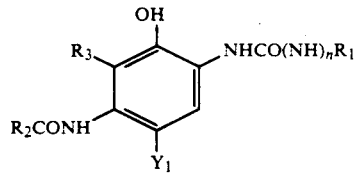

(I)

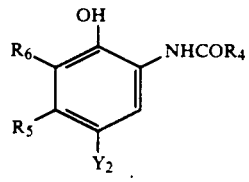

(II)

wherein $R_1$, $R_2$, and $R_4$ each represents a substituted or unsubstituted aliphatic group, a substituted or unsubstituted aromatic group or a substituted or unsubstituted heterocyclic group, $R_3$, $R_5$ and $R_6$ each represents a hydrogen atom, a halogen atom, an aliphatic group, an aromatic group or an acylamino group, and $R_3$ may represent a non-metallic atomic group necessary to form a nitrogen-containing 5-membered or 6-membered ring together with $R_2$, $Y_1$ and $Y_2$ each represents a hydrogen atom or a group capable of being released upon a coupling reaction with an oxidation product of a developing agent, and n represents 0 or 1,

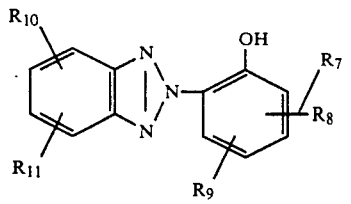

(III)

wherein $R_7$, $R_8$, $R_9$, $R_{10}$ and $R_{11}$, which may be the same or different, each represents a hydrogen atom, a halogen atom, a nitro group, a hydroxy group, an alkyl group, an alkenyl group, an aryl group, an alkoxy group, an acyloxy group, an aryloxy group, an alkylthio group, an arylthio group, a mono- or di-alkylamino group, an acylamino group or a 5-membered or 6-membered heterocyclic group containing an oxygen atom or a nitrogen atom, and $R_{10}$ and $R_{11}$ may combine with each other to form a 5-membered or 6-membered aromatic ring.

DETAILED DESCRIPTION OF THE INVENTION

The cyan couplers represented by the general formula (I) or (II) are described in detail below.

In the cyan coupler represented by the general formula (I) or (II), $R_1$, $R_2$ and $R_4$ each represents an aliphatic group, preferably an aliphatic group having from 1 to 32 carbon atoms (for example, methyl, butyl, tridecyl, cyclohexyl, allyl), an aryl group (for example, phenyl, naphthyl), or a heterocyclic group (for example, 2-pyridyl, 2-imidazolyl, 2-furyl, 6-quinolyl). These groups can be substituted with one or more substitutents selected from an alkyl group, an aryl group, a heterocyclic group, an alkoxy group (for example, methoxy, 2-methoxyethoxy), an aryloxy group (for example, 2,4-di-tert-amylphenoxy, 2-chlorophenoxy, 4-cyanophenoxy), an alkenyloxy group (for example, 2-propenyloxy), an acyl group (for example, acetyl, benzoyl), an ester group (for example, butoxycarbonyl, phenoxycarbonyl, acetoxy, benzoyloxy, butoxysulfonyl, toluenesulfonyloxy), an amido group (for example, acetylamino, methanesulfonamido, dipropylsulfamoylamino), a carbamoyl group (for example, dimethylcarbamoyl, ethylcarbamoyl), a sulfamoyl group (for example, butylsulfamoyl), an imido group (for example, succinimido, hydantoinyl), a ureido group (for example, phenylureido, dimethylureido), an aliphatic or aromatic sulfonyl group (for example, methanesulfonyl, phenylsulfonyl), an aliphatic or aromatic thio group (for example, ethylthio, phenylthio), a hydroxy group, a cyano group, a carboxy group, a nitro group, a sulfo group, and a halogen atom.

When $R_3$, $R_5$ or $R_6$ in the general formulae (I) or (II) represents a substituent which can be substituted per se, it may be further substituted with one or more substituents selected form those as described for $R_1$ above.

In the general formula (II), $R_5$ preferably represents an aliphatic group (for example, methyl, ethyl, propyl, butyl, pentadecyl, tert-butyl, cyclohexyl, cyclohexylmethyl, phenylthiomethyl, dodecyloxyphenylthiomethyl, butanamidomethyl, methoxymethyl).

In the general formulae (I) and (II), $Y_1$ and $Y_2$ each represents a hydrogen atom or a group capable of being released upon coupling (including an atom capable of being released upon coupling). Examples of the groups capable of being released upon coupling include a halogen atom (for example, fluorine, chlorine, bromine), an alkoxy group (for example, ethoxy, dodecyloxy, methoxyethylcarbamoylmethoxy, carboxypropyloxy, methylsulfonylethoxy), an aryloxy group (for example, 4-chlorophenoxy, 4-methoxyphenoxy, 4-carboxyphenoxy), an acyloxy group (for example, acetoxy, tetradecanoyloxy, benzoyloxy), a sulfonyloxy group (for example, methanesulfonyloxy, toluenesulfonyloxy), an amido group (for example, dichloroacetylamino, heptafluorobutyrylamino, methanesulfonylamino, toluenesulfonylamino), an alkoxycarbonyloxy group (for example, ethoxycarbonyloxy, benzyloxycarbonyloxy), an aryloxycarbonyloxy group (for example, phenoxycarbonyloxy), an aliphatic or aromatic thio group (for example, ethylthio, phenylthio, tetrazolylthio), an imido group (for example, succinimido, hydantoinyl), and an aromatic azo group (for example, phenylazo). These groups may contain a photographically useful group.

In the general formula (I), $R_1$ is preferably a substituted or unsubstituted aryl group or a substituted or unsubstituted heterocyclic group. An aryl group substituted with one or more substituents selected from a halogen atom, an alkyl group, an alkoxy group, an aryloxy group, an acylamino group, an acyl group, a carbamoyl group, a sulfonamido group, a sulfamoyl group, a sulfonyl group, a sulfamido group, an oxycarbonyl group and a cyano group is more preferred for $R_1$.

In the general formula (I), when $R_3$ and $R_2$ do not combine with each other to form a ring, $R_2$ is preferably a substituted or unsubstituted alkyl group or substituted or unsubstituted aryl group and particularly preferably an alkyl group substituted with a substituted aryloxy group, and $R_3$ is preferably a hydrogen atom.

In the general formula (II), $R_4$ is preferably a substituted or unsubstituted alkyl group or a substituted or unsubstituted aryl group. An alkyl group substituted with a substituted aryloxy group is particularly preferred for $R_4$.

In the general formula (II), $R_5$ is more preferably an alkyl group having from 1 to 15 carbon atoms. An alkyl group having from 2 to 4 carbon atoms is particularly preferred for $R_5$.

In the general formula (II), $R_6$ is preferably a hydrogen atom or a halogen atom. A chlorine atom or a fluorine atom is particularly preferred for $R_6$.

In the general formula (I) Or (II), $Y_1$ and $Y_2$ are each preferably a hydrogen atom, a halogen atom, an alkoxy group, an aryloxy group, an acyloxy group or a sulfonamido group.

In the general formula (II), $Y_2$ is preferably a halogen atom. A chlorine atom or a fluorine atom is particularly preferred for $Y_2$.

In the general formula (I), when n is 0, $Y_1$ is more preferably a halogen atom. A chlorine atom or a fluorine atom is particularly preferred for $Y_1$.

Preferred examples of the cyan couplers represented by the general formula (I) or (II) according to the present invention will now be set forth below, but the present invention should not be construed as being limited thereto.

(C-1)
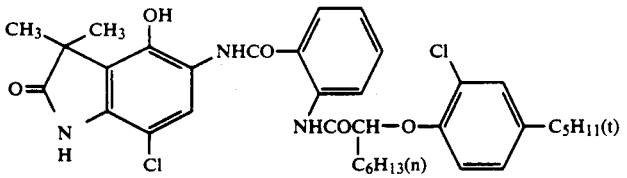
(C-2)
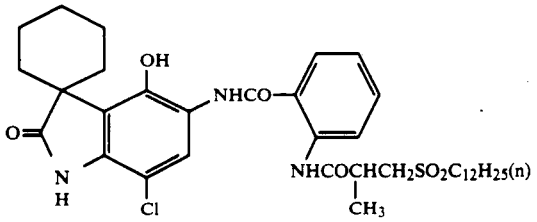
(C-3)
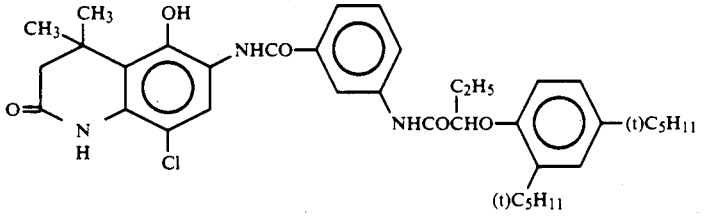
(C-4)
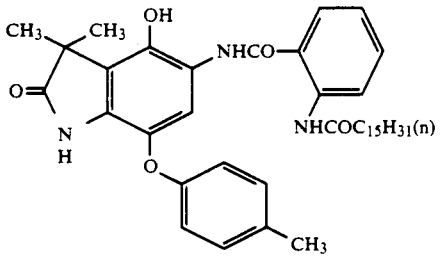
(C-5)
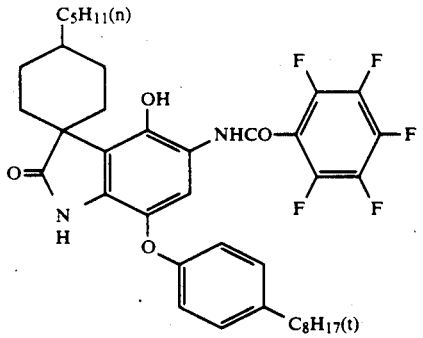
(C-6)
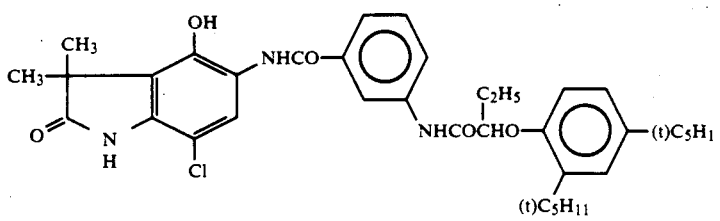

-continued
(C-7)
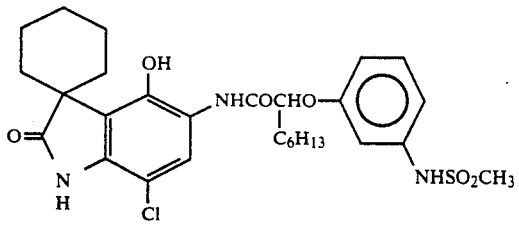
(C-8)
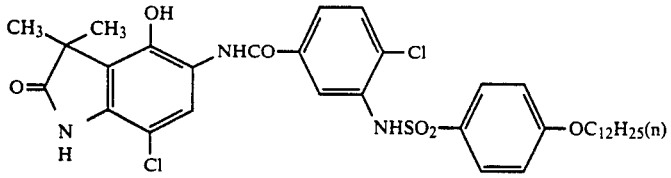
(C-9)
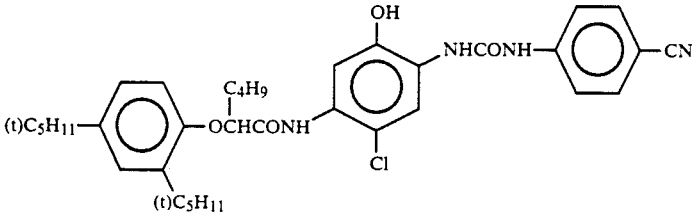
(C-10)
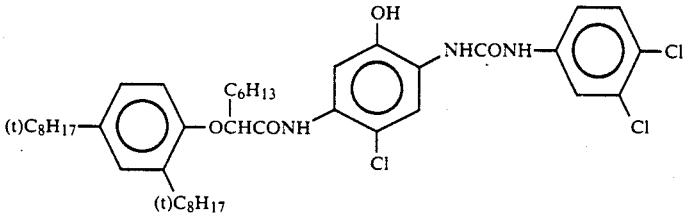
(C-11)
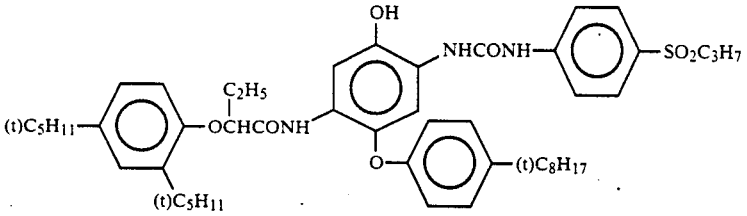
(C-12)
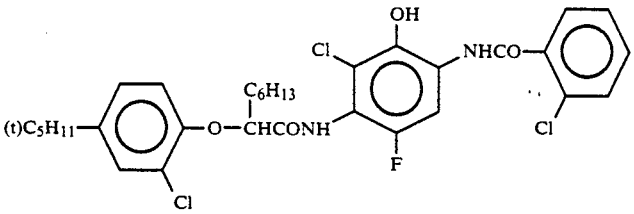
(C-13)
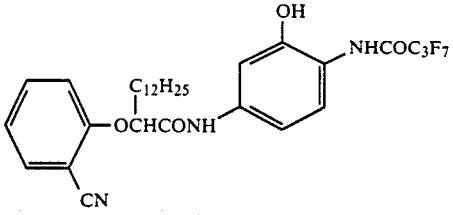

-continued
(C-14)
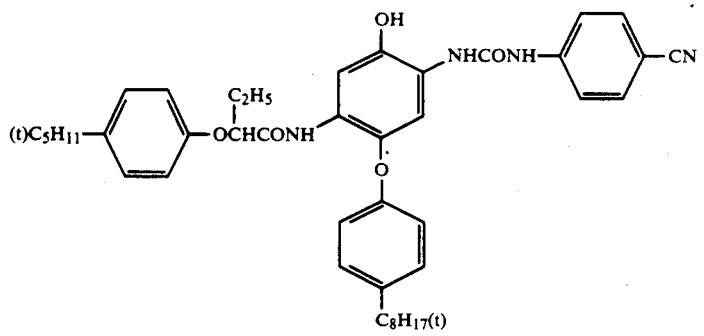
(C-15)
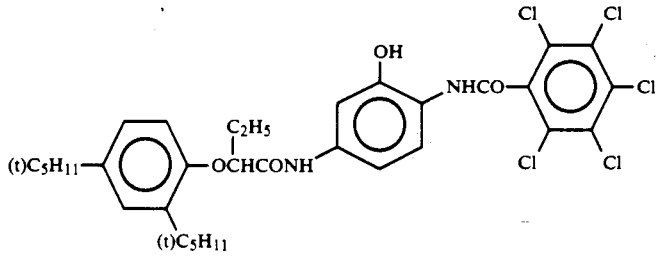
(C-16)
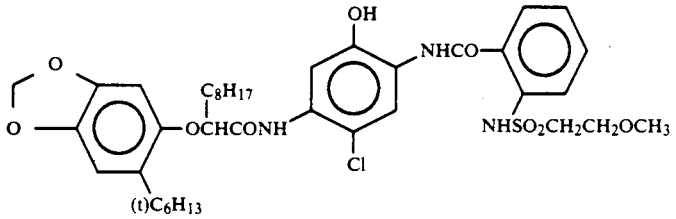
(C-17)
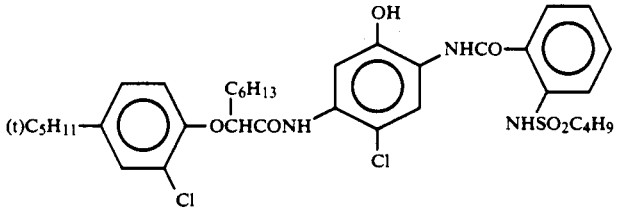
(C-18)
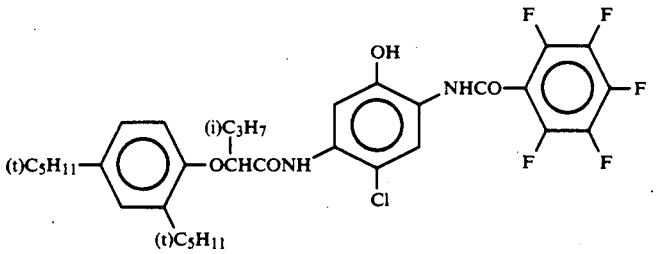
(C-19)
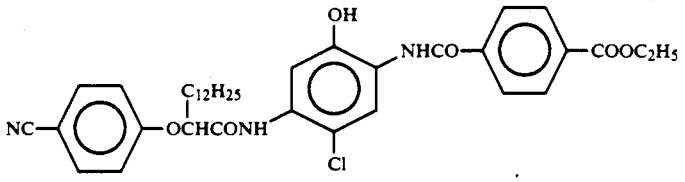

-continued
(C-20)
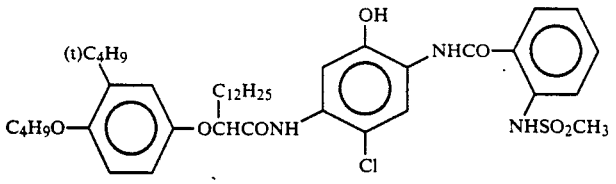
(C-21)
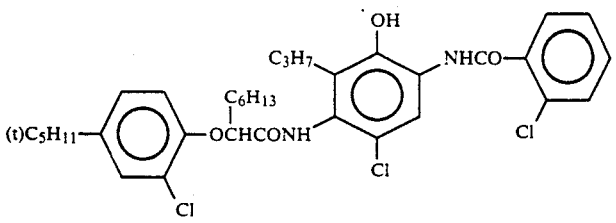
(C-22)
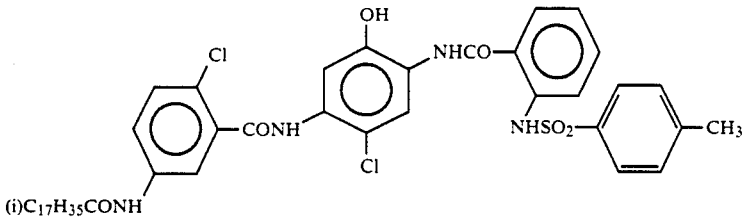
(C-23)
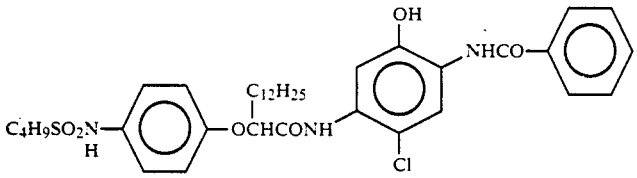
(C-24)
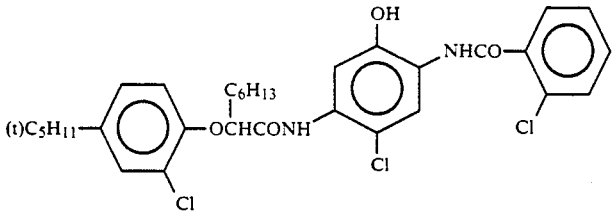
(C-25)
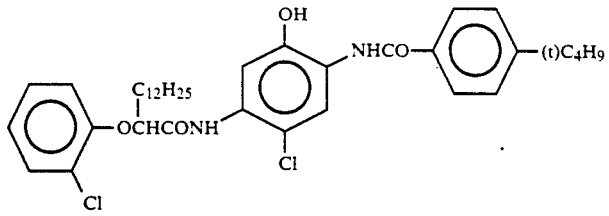
(C-26)
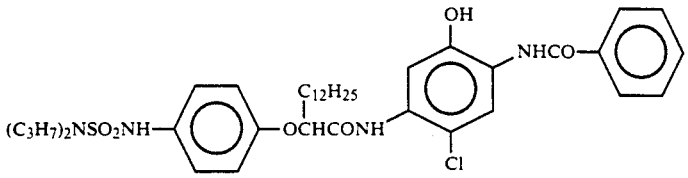

-continued
(C-27)
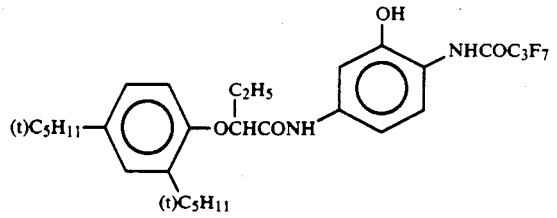
(C-28)
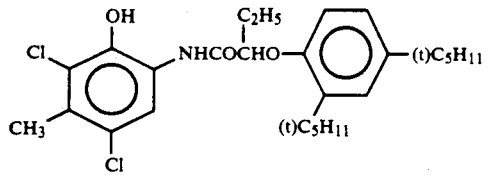
(C-29)
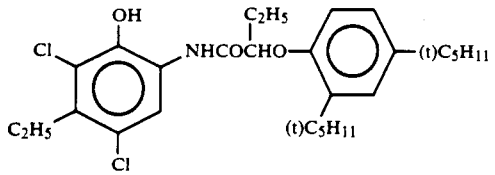
(C-30)
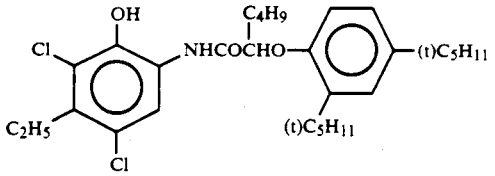
(C-31)
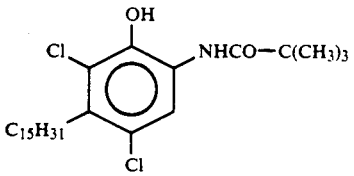
(C-32)
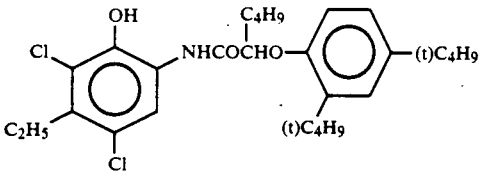
(C-33)
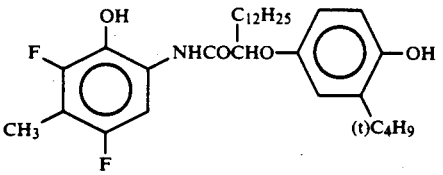
(C-34)
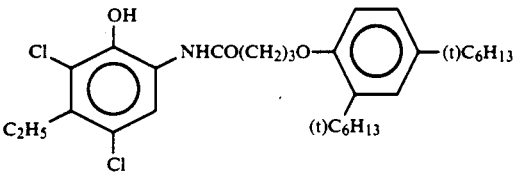

-continued
(C-35)
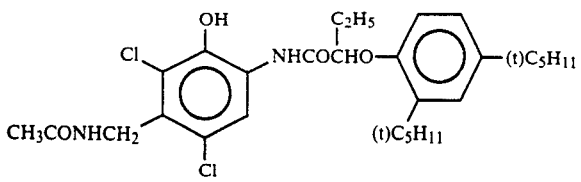
(C-36)
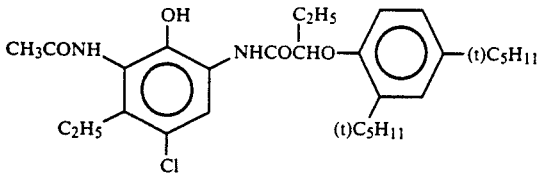
(C-37)
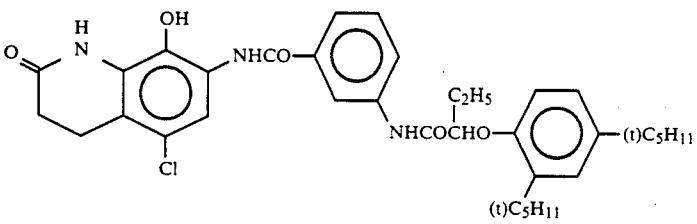
(C-38)
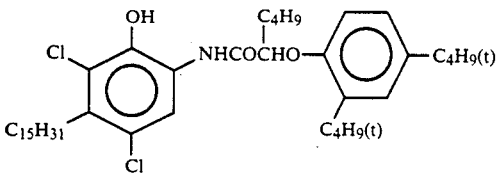
(C-39)
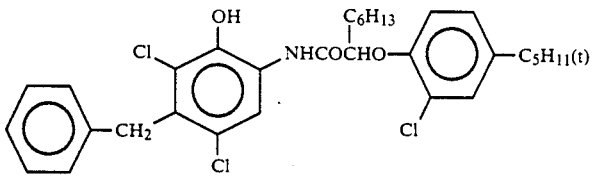
(C-40)
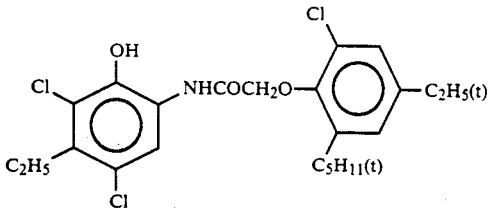
(C-41)
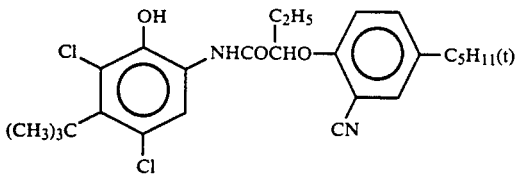
(C-42)
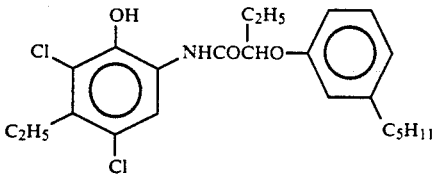

-continued (C-43)

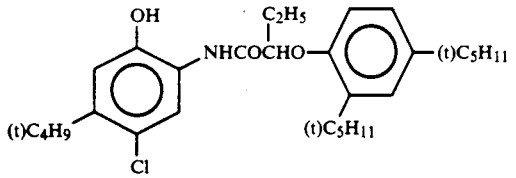

(C-44)

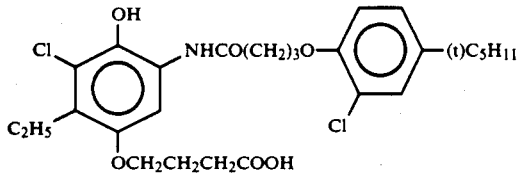

(C-45)

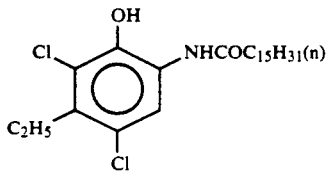

(C-46)

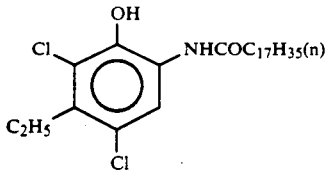

In the following, the polymers which can be employed in the present invention are described in detail.

The water-insoluble and organic solvent-soluble polymers which can be preferably employed in the present invention are non color-forming polymers and more preferably those having a glass transition point of 60° C. or higher, more preferably 90° C. or higher.

According to the present invention, preferred embodiments with respect to the polymers are:

(1) Water-insoluble and organic solvent-soluble homopolymers or copolymers composed of a repeating unit having a linkage of

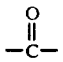

in the main chain or side chain thereof.

More preferred embodiments are:

(2) Water-insoluble and organic solvent soluble homopolymers or copolymer composed of a repeating unit having a linkage of

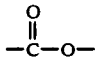

in the main chain or side thereof, and chain (3) Water-insoluble and organic solvent soluble homopolymers or copolymers composed of a repeating unit having a group of

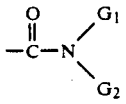

(wherein $G_1$ and $G_2$ each represent a hydrogen atom, a substituted or unsubstituted alkyl group or a substituted or unsubstituted aryl group, provided that both $G_1$ and $G_2$ are not hydrogen atoms at the same time) in the side chain thereof.

Particularly preferred embodiments are water-insoluble and organic solvent-soluble homopolymers or copolymers as described in Item 3) above, wherein one of $G_1$ and $G_2$ is a hydrogen atom and the other is a substituted or unsubstituted alkyl group or a substituted or unsubstituted aryl group each having from 3 to 12 carbon atoms.

The polymers which can be used in the present invention are explained in more detail with reference to specific examples thereof, but the present invention should not be construed as being limited to these polymers.

(A) Vinyl polymers:

Monomers which may be used for forming a vinyl polymer used in the present invention include an acrylic acid ester, a methacrylic acid ester, a vinyl ester, an acrylamide, a methacrylamide, an olefin, a styrene, a vinyl ether and other vinyl monomers.

Specific examples of acrylic acid esters include methyl acrylate, ethyl acrylate, n-propyl acrylate, isopropyl acrylate, n-butyl acrylate, isobutyl acrylate, sec-butyl acrylate, tert-butyl acrylate, amyl acrylate, hexyl acrylate, 2-ethylhexyl acrylate, octyl acrylate, tert-octyl acrylate, 2-chloroethyl acrylate, 2-bromoethyl acrylate, 4-chlorobutyl acrylate, cyanoethyl acrylate, 2-acetoxyethyl acrylate, dimethylaminoethyl acrylate, benzyl acrylate, methoxybenzyl acrylate, 2-chlorocyclohexyl acrylate, cyclohexyl acrylate, furfuryl acrylate, tetrahydrofurfuryl acrylate, phenyl acrylate, 5-hydroxypentyl acrylate, 2,2-dimethyl-3-hydroxypropyl acrylate, 2-methoxyethyl acrylate, 3-methyoxybutyl acrylate, 2-ethoxyethyl acrylate, 2-isopropoxyethyl acrylate, 2-butoxyethyl acrylate, 2-(2-methoxyethoxy)ethyl acrylate, 2-(2-butoxyethoxy)ethyl acrylate, ω-methoxypolyethylene glycol acrylate (addition molar number n=9), 1-bromo-2-methoxyethyl acrylate, 1,1-dichloro-2-ethoxyethyl acrylate, etc.

Specific example of methacrylic acid esters include methyl methacrylate, ethyl methacrylate, n-propyl methacrylate, isopropyl methacrylate, n-butyl methacrylate, isobutyl methacrylate, sec-butyl methacrylate, tert-butyl methacrylate, amyl methacrylate, hexyl methacrylate, cyclohexyl methacrylate, benzyl methacrylate, chlorobenzyl methacrylate, octyl methacrylate, stearyl methacrylate, sulfopropyl methacrylate, N-ethyl-N-phenylaminoethyl methacrylate, 2-(3-phenylpropyloxy)ethyl methacrylate, dimethylaminophenoxyethyl methacrylate, furfuryl methacrylate, tetrahydrofurfuryl methacrylate, phenyl methacrylate, cresyl methacrylate, naphthyl methacrylate, 2-hydroxyethyl methacrylate, 4-hydroxybutyl methacrylate, triethylene glycol monomethacrylate, dipropylene glycol methacrylate, 2-methoxyethyl methacrylate, 3-methoxybutyl methacrylate, 2-acetoxyethyl methacrylate, 2-acetoacetoxyethyl methacrylate, 2-ethoxyethyl methacrylate, 2-isopropxyethyl methacrylate, 2-butoxyethyl methacrylate, 2-(2-methoxyethoxy)ethyl methacrylate, 2-(2-ethoxyethoxy)ethyl methacrylate, 2-(2-butoxyethoxy)ethyl methacrylate, ω-methoxypolyethylene glycol methacrylate (addition molar number n=6), allyl methacrylate, dimethylaminoethyl methacrylate methyl chloride salt, etc.

Specific examples of vinyl esters include vinyl acetate, vinyl propionate, vinyl butyrate, vinyl isobutyrate, vinyl caproate, vinyl chloroacetate, vinyl methoxyacetate, vinyl phenylacetate, vinyl benzoate, vinyl salicylate, etc.

Specific examples of acrylamides include acrylamide, methylacrylamide, ethylacrylamide, propylacrylamide, butylacrylamide, tert-butylacrylamide, cyclohexylacrylamide, benzylacrylamide, hydroxymethylacrylamide, methoxyethylacrylamide, dimethylaminoethylacrylamide, phenylacrylamide, dimethylacrylamide, diethylacrylamide, β-cyanoethylacrylamide, N-(2-acetoacetoxyethyl)acrylamide, diacetonacrylamide, t-octylacrylamide, etc.

Specific examples of methacrylamide include methacrylamide, methylmethacrylamide, ethylmethacrylamide, propylmethacrylamide, butylmethacrylamide, tert-butylmethacrylamide, cyclohexylmethacrylamide, benzylmethacrylamide, hydroxymethylmethacrylamide, methoxyethylmethacrylamide, dimethylaminoethylmethacrylamide, phenylmethacrylamide, dimethylmethacrylamide, diethylmethacrylamide, β-cyanoethylmethaorylamide, N-(2-acetoacetoxyethyl)methacrylamide, etc.

Specific examples of olefins include dicyclopentadiene, ethylene, propylene, 1-butene, 1-pentene, vinyl chloride, vinylidene chloride, isoprene, chloroprene, butadiene, 2,3-dimenthylbutadiene, etc.

Specific examples of styrenes include styrene, methylstyrene, dimethylstyrene, trimethylstyrene, ethyl styrene, isopropylstyrene, chloromethylstyrene, methoxystyrene, acetoxystyrene, chlorostyrene, dichlorostyrene, bromostyrene, vinyl benzoic acid methyl ester, etc.

Specific examples of vinyl ethers include methyl vinyl ether, butyl vinyl ether, hexyl vinyl ether, methoxyethyl vinyl ether, dimethylaminoethyl vinyl ether, etc.

Specific examples of other vinyl monomers include butyl crotonate, hexyl crotonate, dimethyl itaconate, dibutyl itaconate, diethyl maleate, dimethyl maleate, dibutyl maleate, diethyl fumarate, dimethyl fumarate, dibutyl fumarate, methyl vinyl ketone, phenyl vinyl ketone, methoxyethyl vinyl ketone, glycidyl acrylate, glycidyl methacrylate, N-vinyl oxazolidone, N-vinyl pyrrolidone, acrylonitrile, methacrylonitrile, methylene malonnitrile, vinylidene, etc.

Two or more kinds of monomers (for example, those as described above) can be employed together to prepare the polymers according to the present invention depending on various purposes (for example, improvement in the solubility thereof). Further, for the purpose of adjusting color forming ability of the red-sensitive layer and solubility of the polymers, a monomer having an acid group as illustrated below can be employed as a comonomer within the scope in which the copolymer to be obtained is not rendered water-soluble.

Specific examples of such monomers having an acid group include acrylic acid; methacrylic acid; itaconic acid; maleic acid; a monoalkyl itaconate (for example, monomethyl itaconate, monoethyl itaconate, monobutyl itaconate); a monoalkyl maleate (for example, monomethyl maleate, monoethyl maleate, monobutyl maleate); citraconic acid; styrene sulfonic acid; vinylbenzylsulfonic acid; vinylsulfonic acid; an acryloyloxyalkylsulfonic acid (for example, acryloyloxymethylsulfonic acid, acryloyloxyethylsulfonic acid, acryloyloxypropylsulfonic acid); a methacryloyloxyalkylsulfonic acid (for example, methacryloyloxymethylsulfonic acid, methacryloyloxyethylsulfonic acid, methacryloyloxypropylsulfonic acid); an acrylamidoalkylsulfonic acid (for example, 2-acrylamido-2-methylethanesulfonic acid, 2-acrylamido-2-methylpropanesulfonic acid, 2-acrylamido- 2-methylbutanesulfonic acid); a methacrylamidoalkylsulfonic acid (for example, 2-methacrylamido-2-methylethanesulfonic acid, 2-methacrylamido-2-methylpropanesulfonic acid, 2-methacrylamido-2-methylbutanesulfonic acid); etc.

The acid may be in the form of a salt of an alkali metal (for example, sodium, potassium), or an ammonium ion.

In the case where among the vinyl monomer described above and the other vinyl monomer used in the present invention a hydrophilic vinyl monomer which can form a hydrophilic homopolymer is employed as comonomer, the ratio of the hydrophilic monomer contained in the copolymer is not strictly limited so far as the copolymer is not rendered water-soluble. Usually, the ratio of the hydrophilic monomer is preferably not more than 40% by mole, more preferably not more than 20% by mole, and even more preferably not more than 10% by mole. Further, when a hydrophilic comonomer copolymerizable with the monomer of the present invention has an acid group, the ratio of the comonomer having an acid group contained in the copolymer is usually not more than 20% by mole, and preferably not more than 10% by mole from the standpoint of image preservability as described above. In the most preferred case the copolymer does not contain a monomer having an acid group.

Preferred monomers used in making the polymers according to the present invention are methacrylate type monomers, acrylamide type monomers and methacrylamide type monomers. Particularly preferred monomers are acrylamide type monomers and methacrylamide type monomers.

(B) Polymers obtained by condensation polymerization or polyaddition reaction:

As polymers obtained by condensation polymerization, polyesters obtained from polyhydric alcohols and polybasic acids, and polyamides obtained from diamines and dibasic acids, or ω-amino-ω-caboxylic acids are generally known. As polymers obtained by polyaddition, polyurethanes obtained from diisocyanates and dihydric alcohols are known.

Useful polyhydric alcohols include a glycol having a structure of HO—$R_1$—OH (wherein $R_1$ represents a hydrocarbon chain having from 2 to about 12 carbon atoms, particularly an aliphatic hydrocarbon chain) and a polyalkylene glycol, and useful polybasic acids include those represented by the formula HOOC—$R_2$—COOH (wherein $R_2$ represents a single bond or a hydrocarbon chain having from 1 to about 12 carbon atoms).

Specific examples of the polyhydric alcohols include ethylene glycol, diethylene glycol, triethylene glycol, 1,2-propylene glycol, 1,3-propylene glycol, trimethylol propane, 1,4-butanediol, isobutylenediol, 1,5-pentanediol, neopentyl glycol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, glycerol, diglycerol, triglycerol, 1-methylglycerol, erythritol, mannitol, and sorbitol, etc.

Specific examples of polybasic acids include oxalic acid, succinic acid, glutaric acid, adipic acid, pimelic acid, cork acid, azelaic acid, sebacic acid, nonanedicarboxylic acid, decanedicarboxylic acid, undecanedicarboxylic acid, dodecanecarboxylic acid, fumaric acid, maleic acid, itaconic acid, citraconic acid, phthalic acid, isophthalate, terephthalate, tetrachlorophthalate, mesaconic acid, isopimelic acid, cyclopentadiene-maleic anhydride adduct, and rosin-maleic anhydride adduct, etc.

Specific examples of diamines include hydrazine, methylenediamine, ethylenediamine, trimethylenediamine, tetramethylenediamine, hexamethylenediamine, dodecylmethylenediamine, 1,4-diaminocyclohexane, 1,4-diaminomethylcyclohexane, o-aminoaniline, p-aminoaniline, 1,4-diaminomethylbenzene, and (4-aminophenyl)ether, etc.

Specific examples of ω-amino-ω-carboxylic acids include glycine, β-alanine, 3-aminopropionic acid, 4-aminobutyric acid, 5-aminopentanoic acid, 11-aminododecanoic acid, 4-aminobenzoic acid, 4-(2-aminoethyl)benzoic acid, and 4-(4-aminophenyl)butyric acid, etc.

Specific examples of diisocyanates include ethylenediisocyanate, hexamethylenediisocyanate, m-phenylenediisocyanate, p-phenylenediisocyanate, p-xylenediisocyanate, and 1,5-naphthyldiisocyanate, etc.

(C) Other polymers:

Polyesters or polyamides obtained by ring opening codensation a shown below are exemplified.

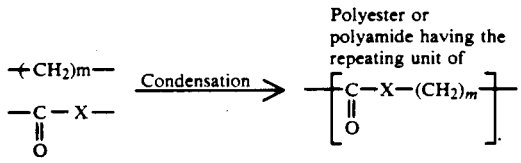

wherein X represents —O— or —NH—; m represents an integer from 4 to 7; and the —$CH_2$— chain may be a branched chain.

Suitable monomers for preparation of the polymers include β-propiolactone, ε-caprolactone, dimethylpropiolactone, α-pyrrolidone, α-pyperidone, ε-caprolactam, and α-methyl-ε-caprolactam, etc.

Two or more kinds of the polymers according to the present invention described above may optionally be used in combination.

Molecular weight and degree of polymerization of the polymer according to the present invention do not substantially effect the present invention. However, as the molecular weight becomes higher, some problems are apt to occur that it takes much time to dissolve the polymer in an auxiliary solvent and that emulsification or dispersion thereof becomes difficult due to high viscosity thereof in solution and coarse grains are formed, resulting in a decrease in color forming property and coating property.

When a large amount of the auxiliary solvent is used to reduce its viscosity in order to traverse such difficulties, new problems on the process may occur.

From such a point of view, the viscosity of the polymer is preferably not more than 5,000 cps, more preferably not more than 2,000 cps when 30 g of the polymer is dissolved in 100 ml of an auxiliary solvent and the solution is kept at 25° C. Also, the molecular weight of the polymer useful in the present invention is preferably not more than 150,000, and more preferably not more than 100,000.

The term "water-insoluble" as used herein with respect to the polymer means that a weight of the polymer soluble in 100 g of distilled water at 25° C. is not more than 3 g, preferably not more than 1 g.

The ratio of the polymer to an auxiliary solvent is different depending on the kind of polymer used, and can be varied over a wide range depending on its solubility in the auxiliary solvent, its degree of polymerization, and the solubility of the coupler. Usually the auxiliary solvent is employed in an amount necessary to make viscosity sufficiently low for easily dispersing a solution containing at least a coupler, a coupler solvent having a high boiling point and the polymer dissolved in the auxiliary solvent in water or an aqueous solution of a hydrophilic colloid. Since the viscosity of the solution increases as the degree of polymerization of the polymer is high, it is difficult that the ratio of the polymer to an auxiliary solvent is determined without regard to the kind of polymer. Usually, however, the polymer to auxiliary solvent ratio of about 1:1 to about 1:50 (by weight) is preferred. The ratio of the polymer according to the present invention to a coupler is preferably from 1:20 to 20:1, and more preferably from 1:10 to 10:1 (by weight).

Specific examples of the polymers which can be used in the present invention are set forth below, but the present invention should not be construed as being limited to these polymers.

| Examples | Polymers |
|---|---|
| P-1 | Polyvinylacetate |
| P-2 | Polyvinylpropionate |
| P-3 | Polymethylmethacrylate |
| P-4 | Polyethylmethacrylate |
| P-5 | Polyethylacrylate |
| P-6 | Copolymer of vinylacetate-vinylalcohol (95:5) |
| P-7 | Poly(n-butylacrylate) |

-continued

| Examples | Polymers |
|---|---|
| P-8 | Poly(n-butylmethacrylate) |
| P-9 | Poly(iso-butylmethacrylate) |
| P-10 | Poly(iso-propylmethacrylate) |
| P-11 | Poly(decylmethacrylate) |
| P-12 | Copolymer of n-butylacrylate-acrylamide (95:5) |
| P-13 | Polymethylchloroacrylate |
| P-14 | 1,4-Butanediol-adipic acid polyester |
| P-15 | Ethyleneglycol-sebacic acid polyester |
| P-16 | Polycaprolactone |
| P-17 | Poly(2-tert-butylphenyl acrylate) |
| P-18 | Poly(4-tert-butylphenyl acrylate) |
| P-19 | Copolymer of n-butylmethacrylate-N-vinyl-2-pyrrolidone (90:10) |
| P-20 | Copolymer of methylmethacrylate-vinyl chloride (70:30) |
| P-21 | Copolymer of methylmethacrylate-styrene (90:10) |
| P-22 | Copolymer of methylmethacrylate-ethylacrylate (50:50) |
| P-23 | Copolymer of n-butylmethacrylate-methylmethacrylate-styrene (50:30:20) |
| P-24 | Copolymer of vinylacetate-acrylamide (85:15) |
| P-25 | Copolymer of vinyl chloride-vinylacetate (65:35) |
| P-26 | Copolymer of methylmethacrylate-acrylonitrile (65:35) |
| P-27 | Copolymer of diacetoneacrylamide-methylmethacrylate (50:50) |
| P-28 | Copolymer of vinylmethylketone-iso-butylmethacrylate (55:45) |
| P-29 | Copolymer of ethylmethacrylate-n-butylacrylate (70:30) |
| P-30 | Copolymer of diacetoneacrylamide-n-butylacrylate (60:40) |
| P-31 | Copolymer of methylmethacrylate-cyclohexylmethacrylate (50:50) |
| P-32 | Copolymer of n-butylacrylate-styrenemethacrylate-diacetoneacrylamide (70:20:10) |
| P-33 | Copolymer of N-tert-butylmethacrylamide-methylmethacrylate-acrylic acid (60:30:10) |
| P-34 | Copolymer of methylmethacrylate-styrene-vinylsulfonamide (70:20:10) |
| P-35 | Copolymer of methylmethacrylate-phenylvinylketone (70:30) |
| P-36 | Copolymer of n-butylacrylate-methyl-methacrylate-n-butylmethacrylate (35:35:30) |
| P-37 | Copolymer of n-butylmethacrylate-pentylmethacrylate-N-vinyl-2-pyrrolidone (38:38:24) |
| P-38 | Copolymer of methylmethacrylate-n-butylmethacrylate-isobutylmethacrylate-acrylic acid (37:29:25:9) |
| P-39 | Copolymer of n-butylmethacrylate-acrylic acid (95:5) |
| P-40 | Copolymer of methylmethacrylate-acrylic acid (95:5) |
| P-41 | Copolymer of benzylmethacrylate-acrylic acid (90:10) |
| P-42 | Copolymer of n-butylmethacrylate-methylmethacrylate-benzylmethacrylate-acrylic acid (35:35:25:5) |
| P-43 | Copolymer of n-butylmethacrylate-methylmethacrylate-benzylmethacrylate (35:35:30) |
| P-44 | Poly(3-pentylacrylate) |
| P-45 | Copolymer of cyclohexylmethacrylate-methylmethacrylate-n-propylmethacrylate (37:29:34) |
| P-46 | Poly(pentylmethacrylate) |
| P-47 | Copolymer of methylmethacrylate-n-butylmethacrylate (65:35) |
| P-48 | Copolymer of vinylacetate-vinylpropionate (75:25) |
| P-49 | Copolymer of n-butylmethacrylate-sodium-3-acryloxybutane-1-sulfonate (97:3) |
| P-50 | Copolymer of n-butylmethacrylate-methylmethacrylate-acrylamide (35:35:30) |
| P-51 | Copolymer of n-butylmethacrylate-methylmethacrylate-vinyl chloride (37:36:27) |

-continued

| Examples | Polymers |
|---|---|
| P-52 | Copolymer of n-butylmethacrylate-styrene (90:10) |
| P-53 | Copolymer of methylmethacrylate-N-vinyl-2-pyrrolidone (90:10) |
| P-54 | Copolymer of n-butylmethacrylate-vinylchloride (90:10) |
| P-55 | Copolymer of n-butylmethacrylate-styrene (70:30) |
| P-56 | Poly(N-sec-butylacrylamide) |
| P-57 | Poly(N-tert-butylacrylamide) |
| P-58 | Copolymer of diacetoneacrylamide-methylmethacrylate (62:38) |
| P-59 | Copolymer of cyclohexylmethacrylate-methylmethacrylate (60:40) |
| P-60 | Copolymer of N-tert-butylacrylamide-methylmethacrylate (40:60) |
| P-61 | Poly(N-n-butylacrylamide) |
| P-62 | Copolymer of tert-butylmethacrylate-N-tert-butylacrylamide (50:50) |
| P-63 | Copolymer of tert-butylmethacrylate-methylmethacrylate (70:30) |
| P-64 | Poly(N-tert-butylmethacrylamide) |
| P-65 | Copolymer of N-tert-butylacrylamide-methylmethacrylate (60:40) |
| P-66 | Copolymer of methylmethacrylate-acrylonitrile (70:30) |
| P-67 | Copolymer of methylmethacrylate-vinylmethylketone (38:62) |
| P-68 | Copolymer of methylmethacrylate-styrene (75:25) |
| P-69 | Copolymer of methylmethacrylate-hexylmethacrylate (70:30) |
| P-70 | Poly(benzylacrylate) |
| P-71 | Poly(4-biphenylacrylate) |
| P-72 | Poly(4-butoxycarbonylphenylacrylate) |
| P-73 | Poly(sec-butylacrylate) |
| P-74 | Poly(tert-butylacrylate) |
| P-75 | Poly[3-chloro-2,2-bis(chloromethyl)-propylacrylate] |
| P-76 | Poly(2-chlorophenylacrylate) |
| P-77 | Poly(4-chlorophenylacrylate) |
| P-78 | Poly(pentachlorophenylacrylate) |
| P-79 | Poly(4-cyanobenzylacrylate) |
| P-80 | Poly(cyanoethylacrylate) |
| P-81 | Poly(4-cyanophenylacrylate) |
| P-82 | Poly(4-cyano-3-thiabutylacrylate) |
| P-83 | Poly(cyclohexylacrylate) |
| P-84 | Poly(2-ethoxycarbonylphenylacrylate) |
| P-85 | Poly(3-ethoxycarbonylphenylacrylate) |
| P-86 | Poly(4-ethoxycarbonylphenylacrylate) |
| P-87 | Poly(2-ethoxyethylacrylate) |
| P-88 | Poly(3-ethoxypropylacrylate) |
| P-89 | Poly(1H,1H,5H-octafluoropentylacrylate) |
| P-90 | Poly(heptylacrylate) |
| P-91 | Poly(hexadecylacrylate) |
| P-92 | Poly(hexylacrylate) |
| P-93 | Poly(iso-butylacrylate) |
| P-94 | Poly(iso-propylacrylate) |
| P-95 | Poly(3-methoxybutylacrylate) |
| P-96 | Poly(2-methoxycarbonylphenylacrylate) |
| P-97 | Poly(3-methoxycarbonylphenylacrylate) |
| P-98 | Poly(4-methoxycarbonylphenylacrylate) |
| P-99 | Poly(2-methoxyethylacrylate) |
| P-100 | Poly(4-methoxyphenylacrylate) |
| P-101 | Poly(3-methoxypropylacrylate) |
| P-102 | Poly(3,5-dimethyladamantylacrylate) |
| P-103 | Poly(3-dimethylaminophenylacrylate) |
| P-104 | Poly(vinyl-tert-butylacrylate) |
| P-105 | Poly(2-methylbutylacrylate) |
| P-106 | Poly(3-methylbutylacrylate) |
| P-107 | Poly(1,3-dimethylbutylacrylate) |
| P-108 | Poly(2-methylpentylacrylate) |
| P-109 | Poly(2-naphtylacrylate) |
| P-110 | Poly(phenylmethacrylate) |
| P-111 | Poly(propylacrylate) |
| P-112 | Poly(m-tolylacrylate) |
| P-113 | Poly(o-tolylacrylate) |
| P-114 | Poly(p-tolylacrylate) |
| P-115 | Poly(N,N-dibutylacrylamide) |
| P-116 | Poly(iso-hexylacrylamide) |
| P-117 | Poly(iso-octylacrylamide) |

-continued

| Examples | Polymers |
|---|---|
| P-118 | Poly(N-methyl-N-phenylacrylamide) |
| P-119 | Poly(adamantylmethacrylate) |
| P-120 | Poly(benzylmethacrylate) |
| P-121 | Poly(2-bromoethylmethacrylate) |
| P-122 | Poly(2-N-tert-butylaminoethylmethacrylate) |
| P-123 | Poly(sec-butylmethacrylate) |
| P-124 | Poly(tert-butylmethacrylate) |
| P-125 | Poly(2-chloroethylmethacrylate) |
| P-126 | Poly(2-cyanoethylmethacrylate) |
| P-127 | Poly(2-cyanomethylphenylmethacrylate) |
| P-128 | Poly(4-cyanophenylmethacrylate) |
| P-128 | Poly(4-cyanophenylmethacrylate) |
| P-129 | Poly(cyclohexylmethacrylate) |
| P-130 | Poly(dodecylmethacrylate) |
| P-131 | Poly(diethylaminoethylmethacrylate) |
| P-132 | Poly(2-ethylsulfinylethylmethacrylate) |
| P-133 | Poly(hexadecylmethacrylate) |
| P-134 | Poly(hexylmethacrylate) |
| P-135 | Poly(2-hydroxypropylmethacrylate) |
| P-136 | Poly(4-methoxycarbonylphenylmethacrylate) |
| P-137 | Poly(3,5-dimethyladamantylmethacrylate) |
| P-138 | Poly(dimethylaminoethylmethacrylate) |
| P-139 | Poly(3,3-dimethylbutylmethacrylate) |
| P-140 | Poly(3,3-dimethyl-2-butylmethacrylate) |
| P-141 | Poly(3,5,5-trimethylhexylmethacrylate) |
| P-142 | Poly(octadecylmethacrylate) |
| P-143 | Poly(tetradecylmethacrylate) |
| P-144 | Poly(4-butoxycarbonylphenylmethacrylamide) |
| P-145 | Poly(4-carboxyphenylmethacrylamide) |
| P-146 | Poly(4-ethoxycarbonylphenylmethacrylamide) |
| P-147 | Poly(4-methoxycarbonylphenylmethacrylamide) |
| P-148 | Poly(butylbutoxycarbonylmethacrylate) |
| P-149 | Poly(butylchloroacrylate) |
| P-150 | Poly(butylcyanoacrylate) |
| P-151 | Poly(cyclohexylchloroacrylate) |
| P-152 | Poly(ethylchloroacrylate) |
| P-153 | Poly(ethlethoxycarbonylmethacrylate) |
| P-154 | Poly(ethylethacrylate) |
| P-155 | Poly(ethylfluoromethacrylate) |
| P-156 | Poly(hexylhexyloxycarbonylmethacrylate) |
| P-157 | Poly(iso-butylchloroacrylate) |
| P-158 | Poly(iso-propylchloroacrylate) |
| P-159 | Trimethylenediamine-glutaric acid polyamide |
| P-160 | Hexamethylenediamine-adipic acid polyamide |
| P-161 | Poly(α-pyrrolidone) |
| P-162 | Poly(ε-caprolactam) |
| P-163 | Hexamethylenediisocyanate-1,4-butanediol polymethane |
| P-164 | p-Phenylenediisocyanate-ethylene glycol polyurethane |

Synthesis methods of the polymers are specifically illustrated below, and other polymers can be synthesized in a known manner.

SYNTHESIS EXAMPLE 1

Synthesis of Polymethylmethacrylate (P-3)

A mixture of 50.0 g of methyl methacrylate, 0.5 g of sodium polyacrylate and 200 ml of distilled water was heated at 80° C. with stirring under a nitrogen atmosphere in a 500 ml three-necked flask. 500 mg of dimethyl azobisisobutyrate was added thereto as a polymerization initiator, whereby polymerization was initiated. After polymerization for 2 hours, the polymerization solution was cooled and the bead-like polymer was collected by filtration and washed with water to obtain 48.7 g of P-3.

SYNTHESIS EXAMPLE 2

Synthesis of Poly (N-tert-butylacrylamide) (P-57)

A mixture of 50.0 g of t-butylacrylamide and 250 ml of toluene was heated at 80° C. with stirring under a nitrogen atmosphere in a 500 ml three-necked flask. 10 ml of a toluene solution containing 500 mg of azobisisobutyronitrile was added thereto as a polymerization initiator, whereby polymerization was initiated. After polymerization for 3 hours, the polymerization solution was cooled and poured into 1 liter of hexane. The solids thus-deposited were collected by filtration, washed with hexane and dried with heating under a reduced pressure to obtain 47.9 g of P-57.

The compounds represented by the general formula (III) used in the present invention are described in detail below.

In the general formula (III), $R_7$, $R_8$, $R_9$, $R_{10}$ and $R_{11}$, which may be the same or different, each represents a hydrogen atom, a halogen atom (for example, chlorine, bromine, iodine, fluorine), a nitro group, a hydroxy group, an alkyl group (for example, methyl, ethyl, n-propyl, isopropyl, aminopropyl, n-butyl, sec-butyl, tert-butyl, chlorobutyl, n-amyl, isoamyl, hexyl, octyl, nonyl, methoxycarbonylethyl, dodecyl, pentadecyl, cyclohexyl, benzyl, phenethyl, phenylpropyl), an alkenyl group (for example, vinyl, allyl, methallyl, dodecenyl, octadecenyl), an aryl group (for example, phenyl, 4-methylphenyl, 4-ethoxyphenyl, 3-hexyloxyphenyl), an alkoxy group (for example, methoxy, ethoxy, propoxy, butoxy, chlorobutoxy, methoxyethoxy, pentadecyloxy), an aryloxy group (for example, phenoxy, 2-methylphenoxy, 4-chlorophenoxy), an acyloxy group (for example, carbomethoxy, carbobutoxy, carbopentadecyloxy), an alkylthio group (for example, methylthio, ethylthio, tert-butylthio, octylthio, benzylthio), an arylthio group (for example, phenylthio, methylphenylthio, ethylphenylthio, methoxyphenylthio, naphthylthio), a mono- or di-alkylamino group (for example, N-ethylamino, N-tert-octylamino, N,N-diethylamino), an acylamino group (for example, acetylamino, benzoylamino, methanesulfonylamino) or a 5-membered or 6-membered heterocyclic group containing an oxygen atom or a nitrogen atom (for example, piperidino, morpholino, pyrrolidino, piperazino); Or $R_{10}$ and $R_{11}$ may combine with each other to form a 5-membered or 6-membered carbon ring.

In the general formula (III), the total number of carbon atoms included in the substituents represented by $R_7$ to $R_{11}$ is preferably from 5 to 36 and the alkyl group preferably contains from 1 to 18 carbon atoms.

Of the compounds represented by the general formula (III), those represented by the following general formula (IV) are particularly preferred.

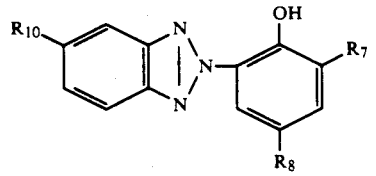

(IV)

wherein $R_7$ and $R_8$ each has the same meaning as defined in the general formula (III); and $R_{10}$ represents a hydrogen atom, a halogen atom, an alkyl group, an alkoxy group, an aryl group or an aryloxy group each has the same meaning as defined in the general formula (III).

Further, the compounds represented by the general formula (IV), wherein $R_{10}$ represents a hydrogen atom or a halogen atom are particularly preferred.

The compound represented by the general formula (III) may be in the form of either solid or liquid at normal temperature.

The amount of the compound represented by the general formula (III) used in the present invention is ordinarily selected in a preferred range from $1\times10^{-4}$ mol/m$^2$ to $2\times10^{-3}$ mol/m$^2$, since if the amount thereof used is too large, yellow coloration may be apt to occur in unexposed areas (white background areas) of the color photographic materials containing it.

Specific examples of the compounds represented by the general formula (III) are set forth below, but the present invention should not be construed as being limited thereto.

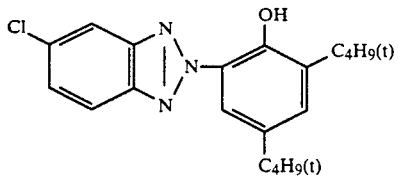
(III-1)

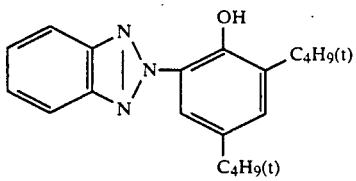
(III-2)

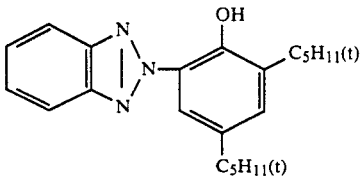
(III-3)

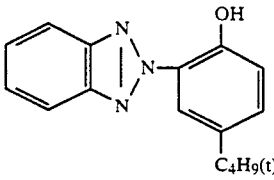
(III-4)

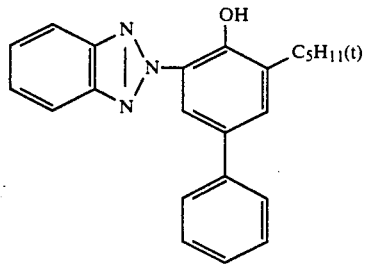
(III-5)

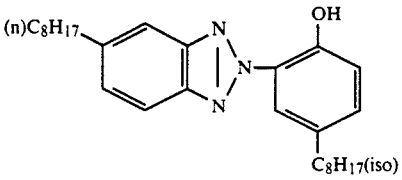
(III-6)

-continued

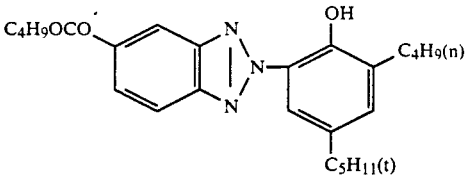
(III-7)

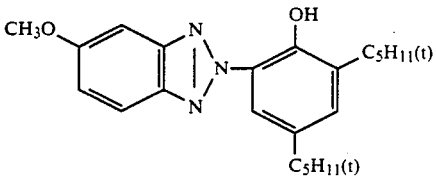
(III-8)

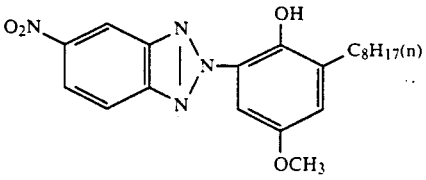
(III-9)

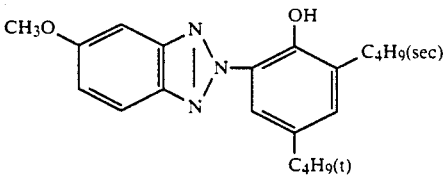
(III-10)

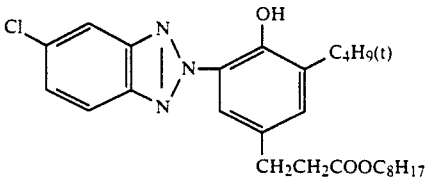
(III-11)

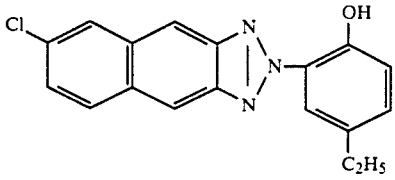
(III-12)

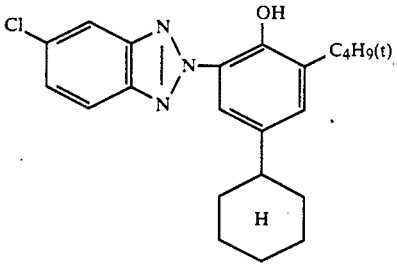
(III-13)

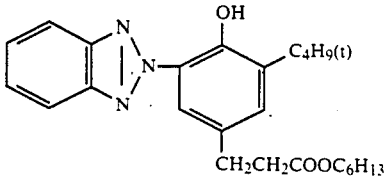
(III-14)

-continued
(III-15)
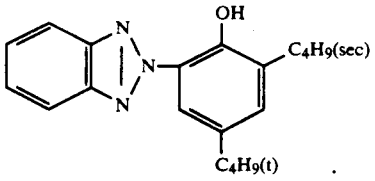
(III-16)
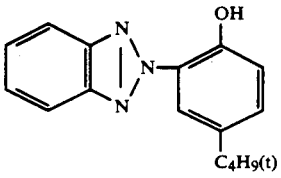
(III-17)
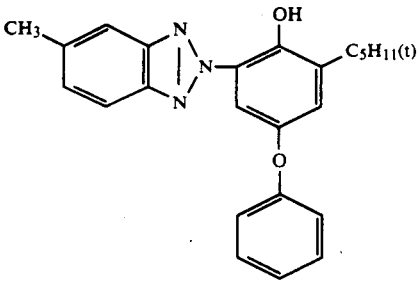
(III-18)
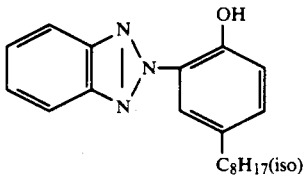
(III-19)
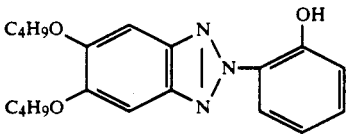
(III-20)
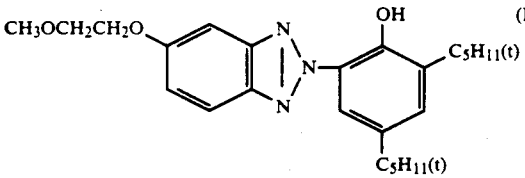
(III-21)
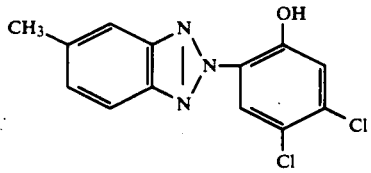
(III-22)
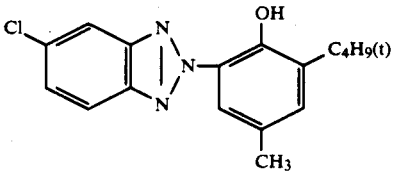
-continued
(III-23)
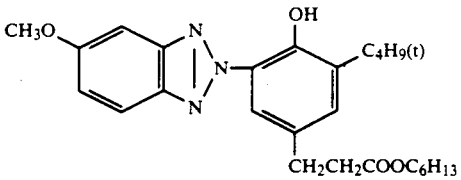
(III-24)
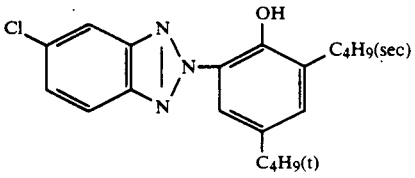
(III-25)
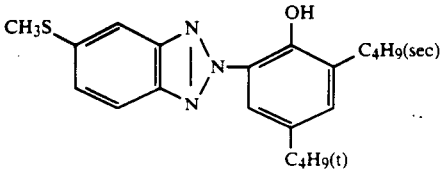
(III-26)
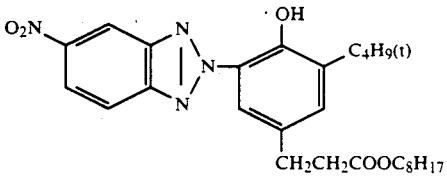
(III-27)
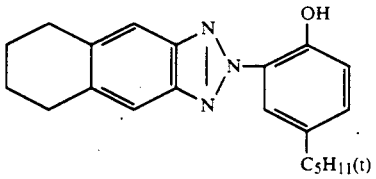
(III-28)
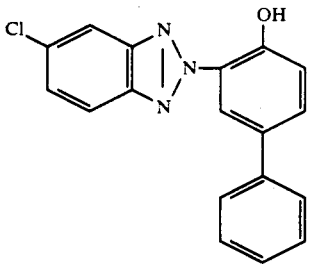
(III-29)
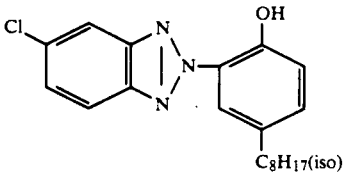
(III-30)
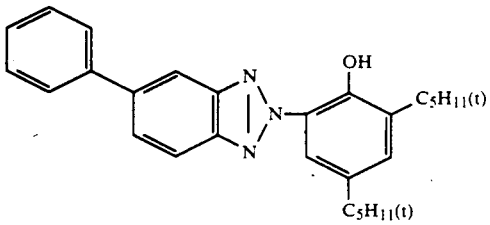

-continued

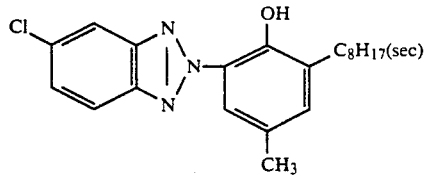

(III-31)

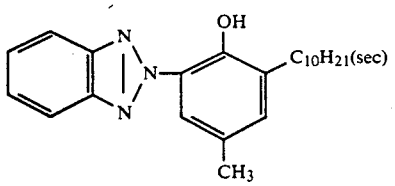

(III-32)

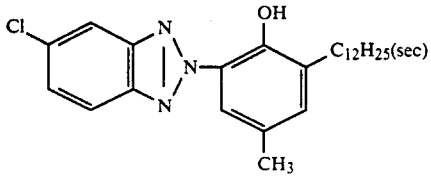

(III-33)

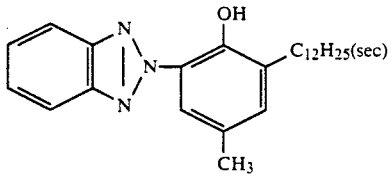

(III-34)

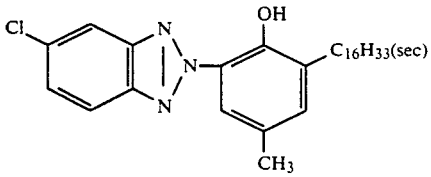

(III-35)

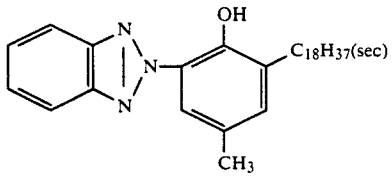

(III-36)

The dispersion of oleophilic fine particles containing the cyan coupler, the Tinuvin type ultraviolet light absorbing agent, and the polymer according to the present invention can be typically prepared in the following manner.

The polymer according to the present invention, which may be synthesized by a solution polymerization method, an emulsion polymerization method, or a suspension polymerization method, etc., and is not cross-linked (i.e., it is a so-called linear polymer), the Tinuvin type ultraviolet light absorbing agent, a coupler solvent preferably having a boiling point of not less than 160° C. and the coupler are completely dissolved in an auxiliary organic solvent. The solution is dispersed in water, preferably in an aqueous solution of a hydrophilic colloid, and more preferably in an aqueous solution of gelatin, with the assistance of a dispersant using ultrasonic agitation, a colloid mill, etc., to form fine particles. Then, the dispersion is mixed with a silver halide emulsion.

Alternatively, water or an aqueous solution of a hydrophilic colloid such as an aqueous solution of gelatin is added to an auxiliary organic solvent containing a dispersant such as a surface active agent, the polymer according to the present invention, the Tinuvin type ultraviolet light absorbing agent, a coupler solvent preferably having a boiling point of not less than 160° C. and the coupler to prepare an oil droplet-in-water type dispersion accompanied by phase inversion.

Further, the dispersion prepared may be mixed with a photographic emulsion after removing the auxiliary organic solvent therefrom by an appropriate method such as distillation, noodle washing or ultrafiltration.

The term "auxiliary organic solvent" as used herein means an organic solvent which is useful in forming an emulsified dispersion, which is finally removed substantially from the photographic light-sensitive material during the drying step after coating or by the above-described method, and which is an organic solvent preferably having a boiling point lower than 160° C. or a solvent having a certain extent of solubility in water and removable by washing with water.

Specific examples of the auxiliary organic solvents include a lower alkyl acetate such as ethyl acetate, butyl acetate, etc., ethyl propionate, sec-butyl alcohol, methyl ethyl ketone, methyl isobutyl ketone, β-ethoxyethyl acetate, methyl cellosolve acetate, and cyclohexanone.

Further, an organic solvent which is fully miscible with water, for example, methyl alcohol, ethyl alcohol, acetone, and tetrahydrofuran may be partially employed together, if desired.

Two or more of such organic solvents can be employed in combination.

The average particle size of the olophilic fine particles thus prepared is preferably from 0.04 μm to 2 μm, more preferably from 0.06 μm to 0.4 μm. The particle size of the oleophilic fine particles can be determined using an appropriate measuring apparatus, for example, Nanosizer manufactured by Coulter Co., England).

For the silver halide emulsion layers of the color photographic material according to the present invention, any of silver bromide, silver iodobromide, silver iodochlorobromide, silver chlorobromide, and silver chloride is used as the silver halide.

In particular, for the purpose of conducting rapid processing, silver chlorobromide containing 90 mol % or more, more preferably 98 mol % or more of silver chloride is preferred. Although such silver chlorobromide may contain a slight amount of silver iodide, it is preferred that it does not contain silver iodide at all.

For the silver halide emulsion layers of the color paper according to the present invention, either silver chlorobromide containing a large amount of silver bromide or silver chlorobromide containing a large amount of silver chloride is used as the silver halide. In particular, for the purpose of conducting rapid processing, the latter silver chlorobromide is preferred.

There is no particular restriction on the average grain size (the grain size being defined as the diameter of the grains when the grain has a spherical or a nearly spherical form and as the length of the edge when the grain has a cubic form, and being the average diameter of a circle having an area corresponding to the projected area of the grains) of the silver halide grains in the photographic emulsions but it is preferred that the grain size be not more than 2 μm, and particularly from 0.2 μm to 1.5 μm.

The silver halide grains in the photographic emulsion layers may have a regular crystal form such as cubic, tetradecahedral, octahedral, etc., or an irregular crystal form such as spherical, tabular, etc., or may have a composite form of these crystal forms. Also, a mixture of grains having various crystal forms may be used. Of these emulsions, the use of a photographic emulsion of regular crystal form is preferred.

Further, a silver halide emulsion wherein tabular silver halide grains having a diameter/thickness ratio of at least 5 accounts for at least 50% of the total projected area of the silver halide grains may be used in the present invention.

A silver halide emulsion employed as at least one layer of the light-sensitive layers is preferably a monodisperse silver halide emulsion having a coefficient of variation (a value which is obtained by dividing a statistical standard deviation with an average grain size and is indicated in terms of a percent) of not more than 15%, more preferably not more than 10%.

Such a monodisperse emulsion may be a single emulsion having the coefficient of variation described above, or an emulsion composed of a mixture of two or more kinds of monodisperse emulsions prepared separately and having different average grain sizes and each having a coefficient of variation of not more than 15%, preferably not more than 10%. The difference in grain size and the mixing ratio of these monodisperse emulsions to be mixed can be appropriately selected. However, emulsions having a difference in average grain size ranging from not less than 0.2 μm to not more than 1.0 μm are preferably employed.

The definition as to the coefficient of variation and the methods of measurement therefor are described in T. H. James, The Theory of The Photographic Process, Third Edition, page 39, The Macmillan Company (1966).

The silver halide grains used in the present invention may have a composition or structure inside the grain which is different from that on the surface layer thereof. Also, the silver halide grains may be of the type that latent images are formed mainly on the surface thereof or of the type that latent images are formed mainly in the interior thereof.

During the formation or physical ripening of the silver halide grains, a cadmium salt, a zinc salt, a thallium salt, a lead salt, an iridium salt or a complex salt thereof, a rhodium salt or a complex salt thereof, an iron salt or a complex salt thereof, etc., may coexist in the system.

Silver halide emulsion are usually chemically sensitized. To the chemical sensitization of the emulsion, conventional methods can be applied, details of which are described in JP-A-62-215272, page 12, from left lower column, line 18 to right lower column, line 16.

Further, silver halide emulsions are usually spectrally sensitized. For the spectral sensitization, methine dyes are ordinarily employed, details of which are described in JP-A-62-215272, from page 22, right upper column, line 3 from the bottom to page 38 and Attachment B to Amendment therefor filed Mar. 16, 1987.

The silver halide emulsions used in the present invention can contain various kinds of compounds for preventing the occurrence of fog or for stabilizing photographic performance during the production, storage and/or photographic processing of color photographic materials. Examples of such compounds include many compounds known as antifoggants or stabilizers such as azoles (e.g., benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles, and in particular, 1-phenyl-5-mercaptotetrazole, etc.), mercaptopyrimidines, mercaptotriazines, etc.; thioketo compounds such as oxazolinethione, etc.; azaindenes (e.g., triazaindenes, tetraazaindenes, in particular, 4-hydroxy-substituted (1,3,3a,7)-tetraazaindene), pentaazaindenes, etc.; benzenethiosulfonic acid, benzenesulfinic acid, benzenesulfonic acid amide, etc.

In the color photographic light-sensitive materials according to the present invention, yellow couplers, magenta couplers and cyan couplers which form yellow, magenta and cyan colors upon coupling with oxidation products of aromatic amine type color developing agents, respectively, are usually employed.

A cyan coupler, a magenta coupler and a yellow coupler which form cyan, magenta and yellow colors, respectively, each is incorporated into a light-sensitive silver halide emulsion layer or the adjacent layers thereof, preferably into a light-sensitive silver halide emulsion layer.

Combinations between these couplers and three silver halide emulsion layers which are different in color sensitivity from each other can be arbitrarily selected. The typical example is an embodiment wherein a cyan coupler, a magenta coupler and a yellow coupler are incorporated into a red-sensitive silver halide emulsion layer, a green-sensitive silver halide emulsion layer and a blue-sensitive silver halide emulsion layer, respectively. A combination between the aforesaid coupler and a silver halide emulsion layer having color sensitivity within a wavelength region of infrared rays in addition with the above described combinations between the coupler and the silver halide emulsion layer having color sensitivity within a wavelength region of visible rays are useful.

Of yellow couplers usable in the present invention, acylacetamido derivatives such as benzoylacetanilides and pivaloylacetanilides are preferred.

Among them, those represented by the general formula (Y-1) or (Y-2) shown below are more preferred as yellow couplers.

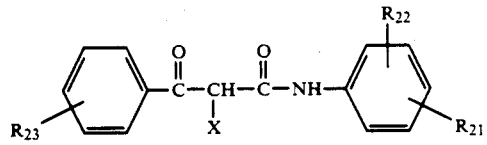

(Y-1)

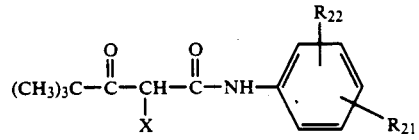

(Y-2)

wherein X represents a hydrogen atom or a group capable of being released upon coupling; $R_{21}$ represents a diffusion resistant group having from 8 to 32 carbon atoms in total; $R_{22}$ represents a hydrogen atom, one or more of halogen atoms, lower alkyl groups, lower alkoxy groups or diffusion resistant groups having from 8 to 32 carbon atoms in total; and $R_{23}$ represents a hydrogen atom or a substituent, when two or more $R_{23}$'s are present, they may be the same or different.

The pivaloylacetanilide type yellow couplers are described in detail in U.S. Pat. No. 4,622,287, column 3, line 15 to column 8, line 39 and U.S. Pat. No. 4,623,616, column 14, line 50 to column 19, line 41.

The benzoylacetanilide type yellow couplers are described in detail in U.S. Pat. Nos. 3,408,194, 3,933,501, 4,046,575, 4,133,958 and 4,401,752.

More specifically, as pivaloylacetanilide type yellow couplers, Compounds (Y-1) to (Y-39) as described in the above mentioned U.S. Pat. No. 4,622,287, column 37 to column 54 are suitable. Of the compounds, Compounds (Y-1), (Y-4), (Y-6), (Y-7), (Y-15), (Y-21), (Y-22), (Y-23), (Y-26), (Y-35), (Y-36), (Y-37), (Y-38) and (Y-39) are preferred.

Further, Compounds (Y-1) to (Y-33) as described in the above mentioned U.S. Pat. No. 4,623,616, column 19 to column 24 are suitable. Of these compounds, Compounds (Y-2), (Y-7), (Y-8), (Y-12), (Y-20), (Y-21), (Y-23) and (Y-29) are preferred.

Moreover, Compound (34) as described in U.S. Pat. No. 3,408,194, column 6; Compounds (16) and (19) as described in U.S. Pat. No. 3,933,501, column 8; Compound (9) as described in U.S. Pat. No. 4,046,575, column 7 to column 8; Compound (1) as described in U.S. Pat. No. 4,133,958, column 5 to column 6; Compound 1 as described in U.S. Pat. No. 4,401,752, column 5, and Compounds a) to g) having the following general formula and substituents shown on the Table below are also preferred.

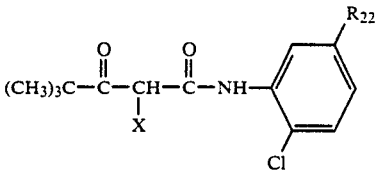

| Compound | $R_{22}$ | X |
|---|---|---|
| a | $-COOCH(CH_3)COOC_{12}H_{25}$ | 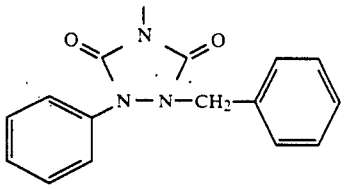 |
| b | $-COOCH(C_4H_9)COOC_{12}H_{25}$ | " |
| c | 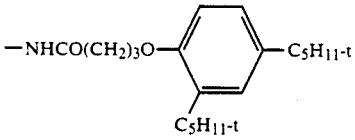 | 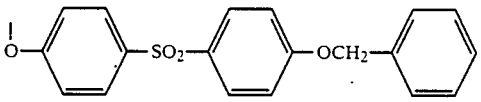 |
| d | " | 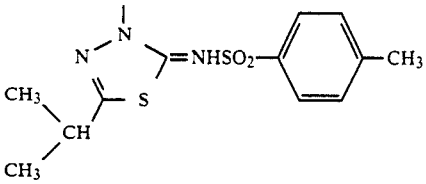 |
| e | " | 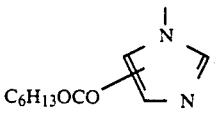 |
| f | $-NHSO_2C_{12}H_{25}$ | 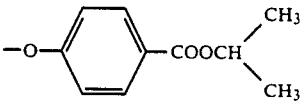 |
| g | $-NHSO_2C_{16}H_{33}$ | 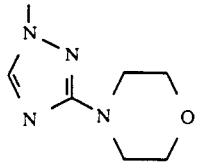 |

-continued

| Compound | $R_{22}$ | X |
|---|---|---|
| h | $-NHCO\underset{\underset{CH_3}{\vert}}{C}HCH_2SO_2C_{12}H_{25}$ | 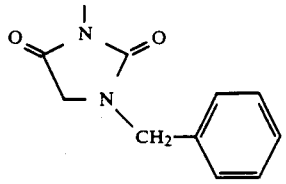 |

Among the couplers described above, those having a nitrogen atom as a releasing atom are preferred.

Examples of magenta couplers usable in the present invention include oil protected indazolone type couplers and cyanoacetyl type couplers, preferably 5-pyrazolone type couplers and pyrazoloazole type couplers such as pyrazolotriazoles. Of 5-pyrazolone type couplers, those substituted with an arylamino group or an acylamino group at the 3-position thereof are preferred in view of hue and color density of the dyes formed. Typical examples thereof are described in U.S. Pat. Nos. 2,311,082, 2,343,703, 2,600,788, 2,908,573, 3,062,653, 3,152,896, and 3,936,015. Two-equivalent 5-pyrazolone type couplers containing nitrogen atom-linked releasing groups as described in U.S. Pat. No. 4,310,619 or arylthio groups as described in U.S. Pat. No. 4,351,897 as releasing groups are preferred. Further, 5-pyrazolone type couplers having a ballast group as described in European Patent 73,636 are advantageous because they provide high color density.

Examples of pyrazoloazole type couplers include pyrazolobenzimidazoles as described in U.S. Pat. No. 3,369,879, and preferably pyrazolo[5,1-c][1,2,4]triazoles as described in U.S. Pat. No. 3,725,067, pyrazolotetrazoles as described in *Research Disclosure,* No. 24220 (June, 1984), and pyrazolopyrazoles as described in *Research Disclosure,* No. 24230 (June, 1984). The above described couplers may be in the form of polymer couplers.

These compounds are specifically represented by the following general formula (M-1), (M-2) or (M-3):

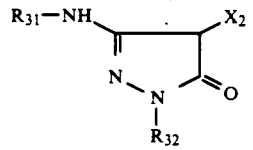

(M-1)

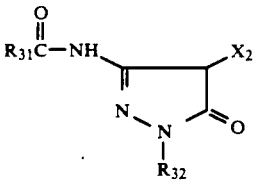

(M-2)

-continued

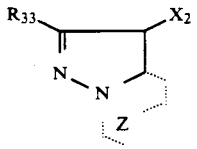

(M-3)

wherein $R_{31}$ represents a diffusion resistant group having from 8 to 32 carbon atoms in total; $R_{32}$ represents a phenyl group or a substituted phenyl group; $R_{33}$ represents a hydrogen atom or a substituent; Z represents a non-metallic atomic group necessary to form a 5-membered azole ring containing two to four nitrogen atom, which azole ring may have one or more substituents (including a condensed ring); and $X_2$ represents a hydrogen atom or a group capable of being released.

The substituents for $R_{33}$ and the substituents on the azole ring are described in detail in U.S. Pat. No. 4,540,654, column 2, line 41 to column 8, line 27.

Among the pyrazoloazole type couplers, imidazo[1,2-b]pyrazoles as described in U.S. Pat. No. 4,500,630 are preferred, and pyrazolo[1,5-b][1,2,4]triazoles as described in U.S. Pat. No. 4,540,654 are particularly preferred in view of less yellow subsidiary absorption and light fastness of the dyes formed.

In addition, pyrazolotriazole couplers wherein a branched chain alkyl group is directly connected to the 2-, 3- or 6-position of the pyrazolotriazole ring as described in JP-A-61-65245, pyrazoloazole couplers containing a sulfonamido group in their molecules as described in JP-A-61-65246, pyrazoloazole couplers having an alkoxyphenylsulfonamido ballast group as described in JP-A-61-147254, and pyrazolotriazole couplers having an alkoxy group or an aryloxy group at the 6-position as described in European Patent Application (OPI) No. 226,849 are preferably employed.

Specific examples of the magenta couplers used in the present invention are set forth below, but the present invention should not be construed as being limited thereto.

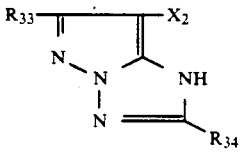

| Compound | $R_{33}$ | $R_{34}$ | $X_2$ |
|---|---|---|---|
| M-1 | $CH_3$— | 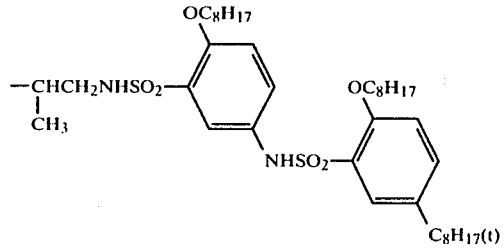 | Cl |
| M-2 | " | 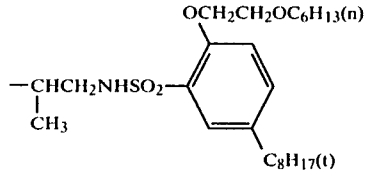 | " |
| M-3 | " | 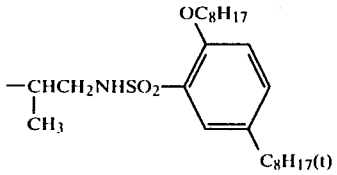 | 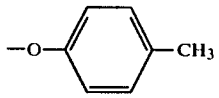 |
| M-4 | 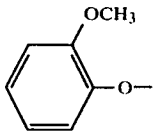 | 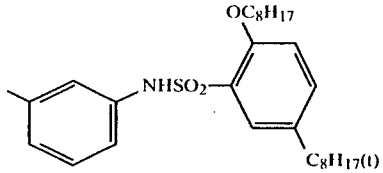 | 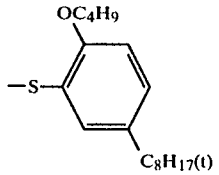 |
| M-5 | $CH_3$— | 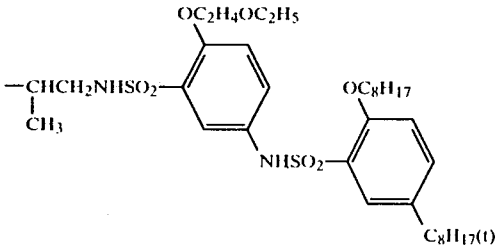 | Cl |

-continued
| Compound | $R_{33}$ | $R_{34}$ | $X_2$ |
|---|---|---|---|
| M-6 | " | 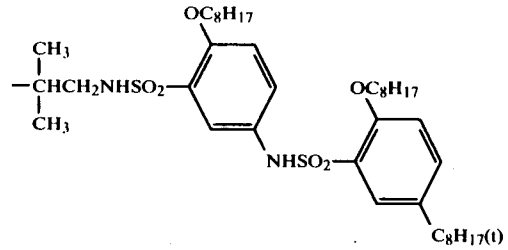 | " |
| M-7 | 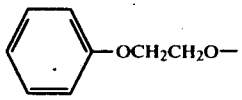 | 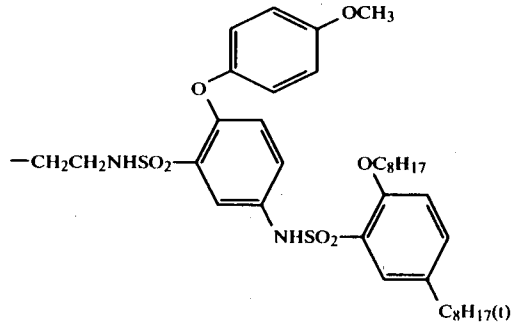 | 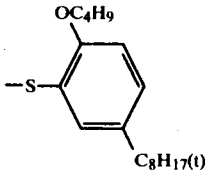 |
| M-8 | $CH_2CH_2O-$ | " | " |
| M-9 | 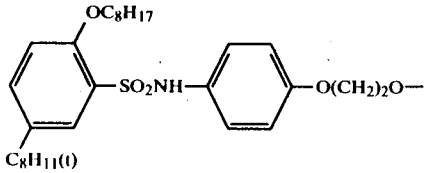 | 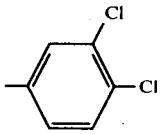 | " |
| M-10 | 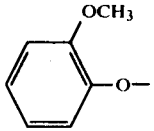 | 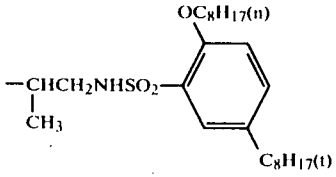 | Cl |

-continued
| Compound | $R_{33}$ | $R_{34}$ | $X_2$ |
|---|---|---|---|
| | | 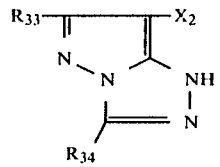 | |
| M-11 | $CH_3-$ | 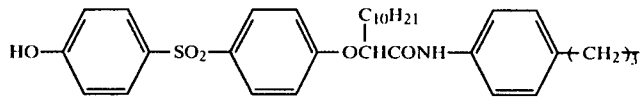 | Cl |
| M-12 | " | 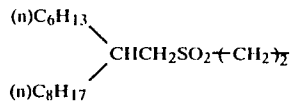 | " |
| M-13 | 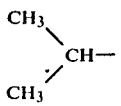 | 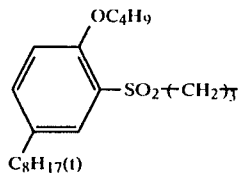 | " |
| M-14 | 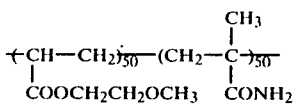 | 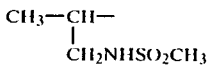 | " |
| M-15 | 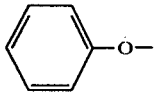 | 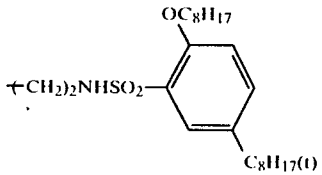 | Cl |

-continued
| Compound | $R_{33}$ | $R_{34}$ | $X_2$ |
|---|---|---|---|
| M-16 | 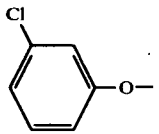 | 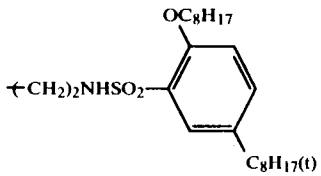 | 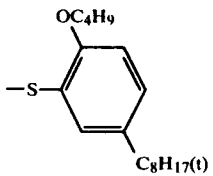 |
| (M-17) | 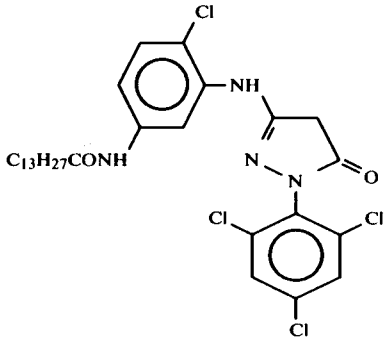 | | |
| (M-18) | 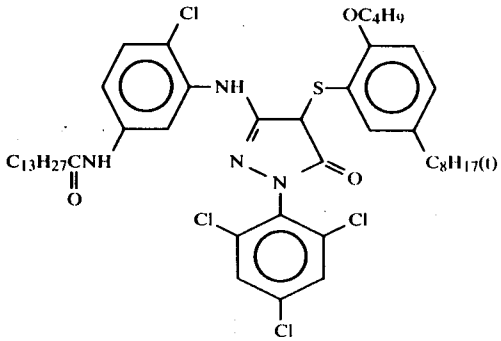 | | |

-continued
| Compound | $R_{33}$ | $R_{34}$ | $X_2$ |
|---|---|---|---|
| (M-19) | 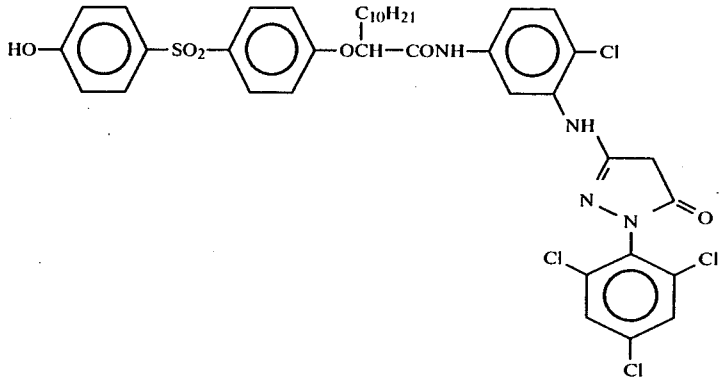 | | |
| (M-20) | 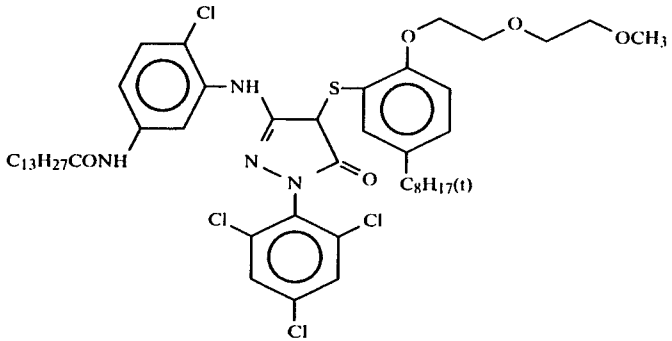 | | |
The symbol, 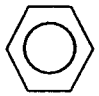 has the same meaning as the symbol, 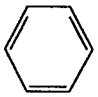 .

-continued
| Compound | $R_{33}$ | $R_{34}$ | $X_2$ |
|---|---|---|---|
| (M-21) | 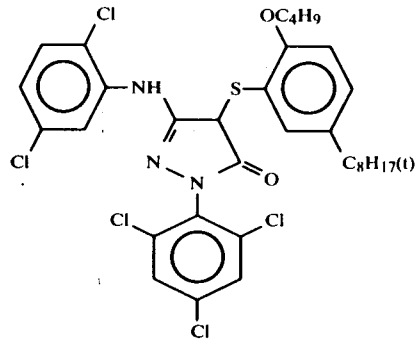 | | |
| (M-22) | 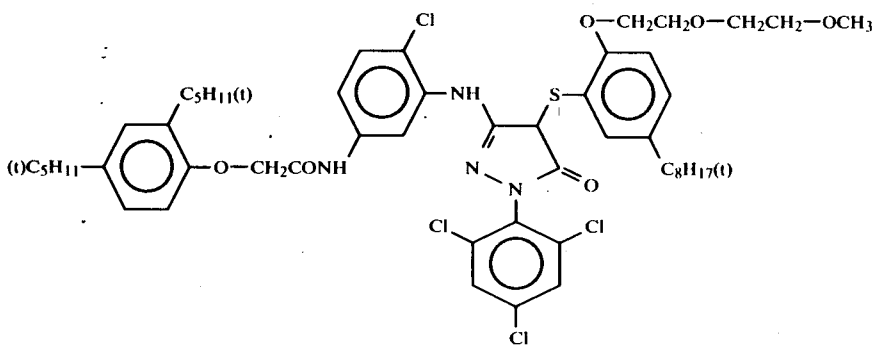 | | |
| (M-23) | 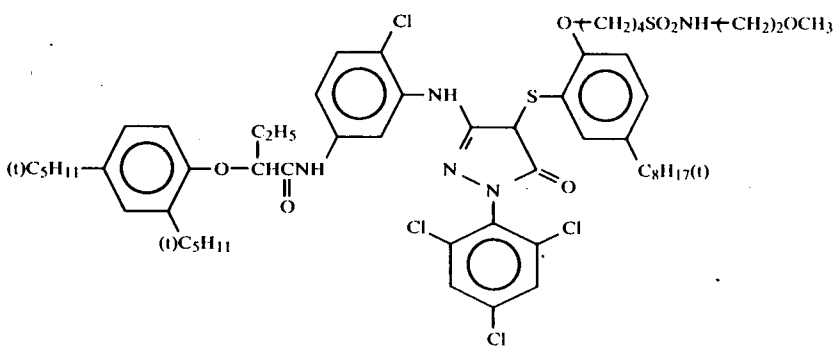 | | |

-continued
| Compound | $R_{33}$ | $R_{34}$ | $X_2$ |
|---|---|---|---|
| (M-24) | 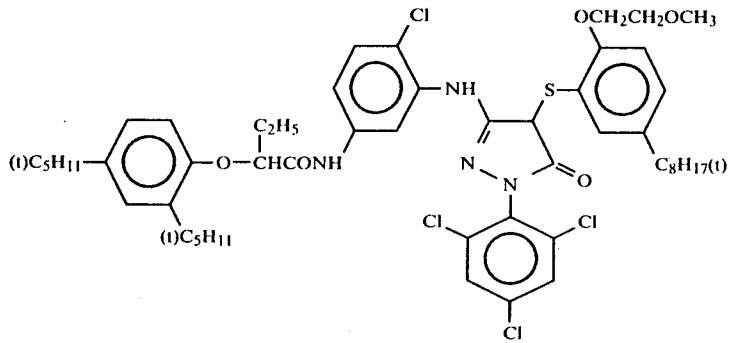 | | |
| (M-25) | 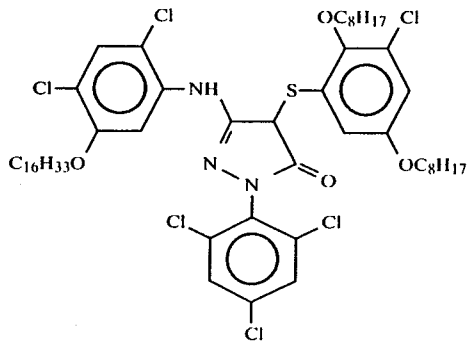 | | |
| (M-26) | 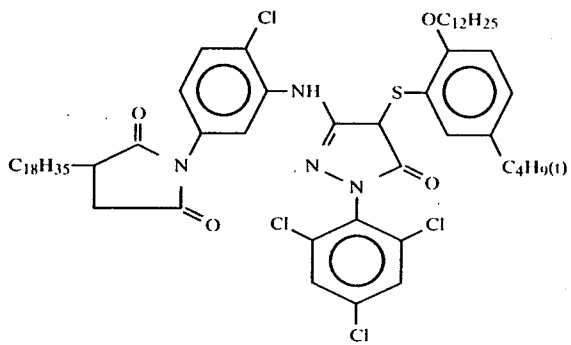 | | |

-continued
| Compound | $R_{33}$ | $R_{34}$ | $X_2$ |
|---|---|---|---|
| (M-27) | 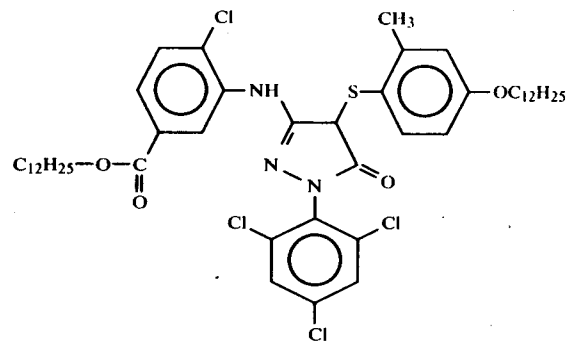 | | |
| (M-28) | 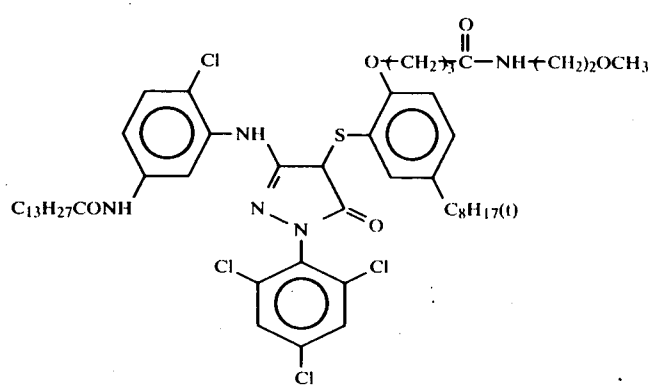 | | |

-continued
| Compound | $R_{33}$ | $R_{34}$ | $X_2$ |
|---|---|---|---|
| (M-29) | 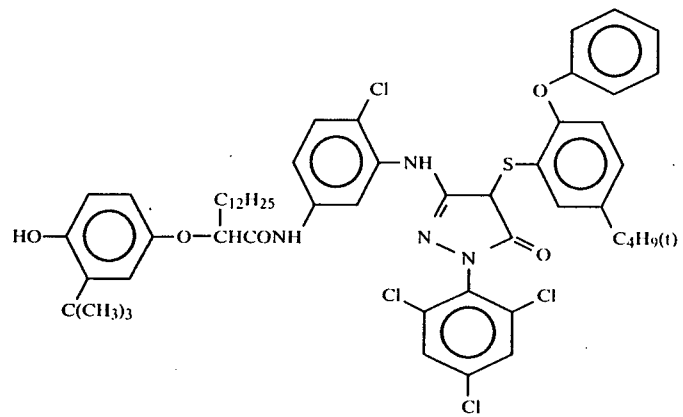 | | |
| (M-30) | 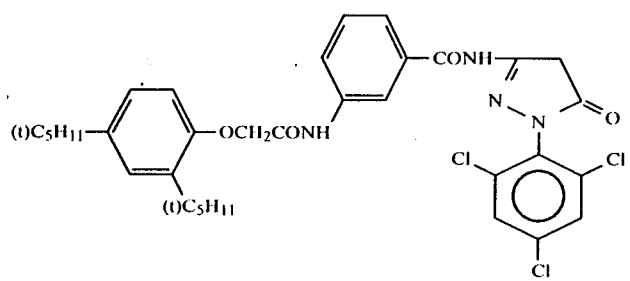 | | |
| (M-31) | 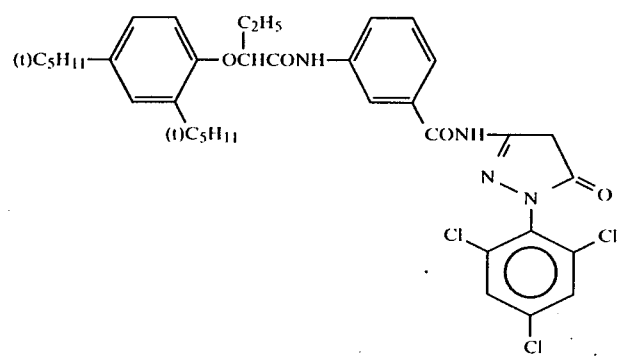 | | |

-continued
| Compound | $R_{33}$ | $R_{34}$ | $X_2$ |
|---|---|---|---|
| (M-32) | | 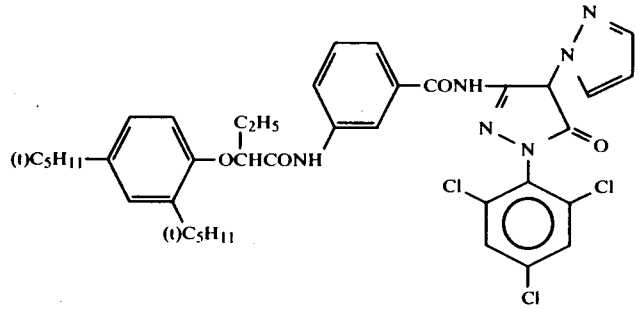 | |
| (M-33) | | 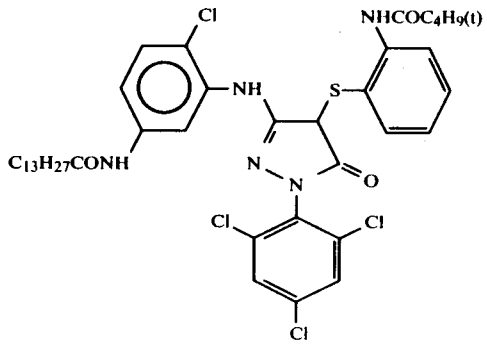 | |

The amount of the coupler incorporated into the silver halide emulsion layer used in the present invention is usually in a range from 0.01 mol to 2.0 mol and preferably in a range from 0.1 mol to 1.0 mol.

Since the couplers used in the present invention are oil-soluble, it is preferred that they are dissolved in a solvent having a high boiling point, and, if desired, together with a solvent having a low boiling point, the solution is emulsified or dispersed in an aqueous solution of gelatin, and then the dispersion is added to a silver halide emulsion. In such a case, hydroquinone derivatives, auxiliary ultraviolet light absorbing agents and/or known color fading preventing agents may be employed together with the coupler, if desired.

The method of adding the coupler used in the present invention is further described in detail below. The coupler, if desired, together with a hydroquinone derivative, an ultraviolet light absorbing agent and/or a color fading preventing agent is dissolved in any one of solvents having a high boiling point represented by, for example, the general formula (V), (VI), (VII), (VIII), (IX) or (X), or, if desired, in a solvent having a low boiling point, for example, ethyl acetate, butyl acetate, butyl propionate, cyclohexanol, cyclohexane or tetrahydrofuran (wherein these solvents having a high boiling point and those having a low boiling are employed individually or in combination), mixed with an aqueous solution containing a hydrophilic binder such as gelatin together with an anionic surface active agent such as alkyl benzenesulfonic acid or alkylnaphthalenesulfonic acid and/or a nonionic surface active agent such as sorbitan sesquioleic acid ester or sorbitan monolauric acid ester, then emulsified or dispersed by means of a high speed mixer, a colloid mill or an untrasonic dispersing apparatus, and finally added to a silver halide emulsion.

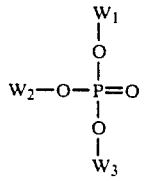
(V)

$W_1—COOW_2$ (VI)

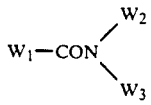
(VII)

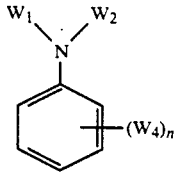
(VIII)

$W_1—O—W_2$ (IX)

$HO—W_5$ (X)

wherein $W_1$, $W_2$ and $W_3$ each represents a substituted or unsubstituted alkyl group, a substituted or unsubstituted cycloalkyl group, a substituted or unsubstituted alkenyl group, a substituted or unsubstituted aryl group or a substituted or unsubstituted heterocyclic group; $W_4$ represents $W_1$, —O—$W_1$ or —S—$W_1$; n represents an integer from 1 to 5 and when n is two or more, two or more $W_4$'s may be the same or different; $W_1$ and $W_2$ in the general formula (IX) may combine with each other to form a condensed ring; $W_5$ represents a substituted or unsubstituted alkyl group or a substituted or unsubstituted aryl group and the total number of carbon atoms included in $W_5$ is not less than 12.

The detail of the high boiling organic solvent as described above is described in JP-A-62-215272, page 137, light lower column to page 144, light upper column.

As the coupler solvent having a high boiling point which is employed in the present invention, any compound which has a melting point of 100° C. or lower and a boiling point of 140° C. or higher and which is immiscible with water and a good solvent for a coupler may be utilized, in addition to the above described solvents represented by the general formulae (V) to (X). The boiling point of the coupler solvent having a high boiling point is preferably not less than 160° C., more preferably not less than 170° C.

The boiling point of the solvent having a low boiling point is preferably lower than 160° C.

When the melting point of the coupler solvent used exceeds about 100° C., crystallization of couplers is apt to occur and improving effect on color forming property tends to decrease.

The color photographic light-sensitive material according to the present invention may contain a hydroquinone derivative, an aminophenol derivative, an amine, a gallic acid derivative, a catechol derivative, an ascorbic acid derivative, a colorless compound-forming coupler, or a sulfonamidophenol derivative as a color fog preventing agent or a color stain preventing agent.

In the color photographic light-sensitive material according to the present invention, various discoloration inhibitors can be employed. More specifically, representative examples of organic discoloration inhibitors for cyan, magenta and/or yellow images include hindered phenols (for example hydroquinones, 6-hydroxychromanes, 5-hydroxycoumarans, spirochromanes, p-alkoxyphenols, or bisphenols), gallic acid derivatives, methylenedioxybenzenes, aminophenols, hindered amines, or ether or ester derivatives thereof derived from each of these compounds by sililation or alkylation of the phenolic hydroxy group thereof. Further, metal complexes represented by (bis-salicylaldoxymato) nickel complexes and (bis-N,N-dialkyldithiocarbamato) nickel complexes may be employed.

Specific examples of the organic discoloration inhibitors are described in the following patents or patent applications.

Hydroquinones: U.S. Pat. Nos. 2,360,290, 2,418,613, 2,700,453, 2,701,197, 2,710,801, 2,728,659, 2,732,300, 2,735,765, 2,816,028, 3,982,944 and 4,430,425, British Patent 1,363,921, etc.; 6-hydroxychromanes, 5-hydroxycoumarans and spirochromanes: U.S. Pat. Nos. 3,432,300, 3,573,050, 3,574,627, 3,698,909 and 3,764,337, JP-A-52-152225, etc.; spiroindanes: U.S. Pat. No. 4,360,589, etc.; p-alkoxyphenols: U.S. Pat. No. 2,735,765, British Patent 2,066,975, JP-A-59-10539, JP-B-57-19764 (the term "JP-B" as used herein means an "examined Japanese patent publication"), etc.; hindered phenols: U.S. Pat. No. 3,700,455, JP-A-52-72225, U.S. Pat. No. 4,228,235, JP-B-52-6623, etc.; gallic acid derivatives, methylenedioxybenzenes and aminophenols: U.S. Pat. Nos. 3,457,079 and 4,332,886, JP-B-56-21144, etc.; hindered amines: U.S. Pat. Nos. 3,336,135 and 4,268,593, British Patents 1,326,889, 1,354,313 and 1,410,846, JP-B-51-1420, JP-A-58-114036, JP-A-59-

53846, JP-A-59-78344, etc.; ether or ester derivatives of phenolic hydroxy group: U.S. Pat. Nos. 4,155,765, 4,174,220, 4,254,216 and 4,264,720, JP-A-54-145530, JP-A-55-6321, JP-A-58-105147, JP-A-59-10539, JP-B-57-37856, U.S. Pat. No. 4,279,990, JP-B-53-3263, etc.

Further, specific examples of the metal complexes are described in U.S. Pat. Nos. 4,050,938 and 4,241,155, British Patent 2,027,731, etc.

The discoloration inhibitor is co-emulsified with the corresponding coupler in an amount of from 5 to 100% by weight of the coupler and incorporated into the light-sensitive layer to achieve the effects of the present invention.

In order to prevent degradation of the cyan dye image due to heat, particularly due to light, it is effective to introduce an auxiliary ultraviolet light absorbing agent to both layers adjacent to the cyan color forming layer.

Among the above described discoloration inhibitors, spiroindanes and hindered amines are particularly preferred.

Suitable examples of the auxiliary ultraviolet light absorbing agents described above include aryl group-substituted benzotriazole compounds (for example, those as described in U.S. Pat. No. 3,533,794), 4-thiazolidone compounds (for example, those as described in U.S. Pat. Nos. 3,314,794 and 3,352,681), benzophenone compounds (for example, those as described in JP-A-46-2784), cinnamic acid ester compounds (for example, those as described in U.S. Pat. Nos. 3,705,805 and 3,707,375), butadiene compounds (for example, those as described in U.S. Pat. No. 4,045,229), and bisphenol derivatives (for example, those as described in U.S. Pat. No. 3,700,455). Furthermore, ultarviolet light absorptive couplers (for example, α-naphtholic cyan dye forming couplers) or ultraviolet light absorptive polymers may be used as ultraviolet light absorbing agents. In the red-sensitive emulsion layer, the above described auxiliary ultraviolet light absorbing agent may be employed together with the compound represented by the general formula (III).

These auxiliary ultraviolet light absorbing agents may be mordanted in a specific layer.

The color photographic light-sensitive material according to the present invention may contain water-soluble dyes as filter dyes or for irradiation prevention or other various purposes in the hydrophilic colloid layers. Examples of such water-soluble dyes include oxonol dyes, hemioxonol dyes, styryl dyes, merocyanine dyes, cyanine dyes, and azo dyes. In these dyes, oxonol dyes, hemioxonol dyes, and merocyanine dyes are particularly useful.

Useful oxonol dyes are described in detail in JP-A-62-215272, from page 158, right upper column to page 163.

As the binder or protective colloids which can be used for the emulsion layers of the color photographic light-sensitive material according to the present invention, gelatin is advantageously used, but other hydrophilic colloids can be used alone or together with gelatin.

As examples of gelatin, lime-processed gelatin or acid-processed gelatin can be used in the present invention. Details of the production of gelatin are described in Arthur Veis, *The Macromolecular Chemistry of Gelatin*, published by Academic Press, 1964.

As the support used in the present invention, there are those conventionally employed in photographic light-sensitive materials, for example, cellulose nitrate films, cellulose acetate films, cellulose acetate butyrate films, cellulose acetate propionate films, polystyrene films, polyethylene terephthalate films, polycarbonate films, laminates of these films, thin glass films, papers, etc. Paper coated with baryta or an α-olefin polymer, in particular, a polymer of an α-olefin having 2 to 10 carbon atoms such as polyethylene, polypropylene, or ethylenebutene copolymer, vinyl chloride resin containing a reflective material such as titatium dioxide, and a support such as a plastic film having a roughened surface for improving the adhesion with other polymers as described in JP-B-47-19068 give good results. Also, a resin hardenable by the irradiation of ultraviolet rays can be used.

According to the purpose of the color photographic light-sensitive material, a transparent support or an opaque support may be used. Also, a colored transparent support containing dyes or pigments can also be used.

As opaque supports used in the present invention, there are papers which are opaque by themselves and transparent films which were opacified by the incorporation of dyes or pigments such as titanium oxide. Also, a plastic film surface-treated by the method described in JP-B-47-19068 can be used.

A subbing layer is usually provided on a support. Furthermore, for improving the adhesive property, a pretreatment such as corona discharging treatment, ultraviolet irradiation treatment, or flame treatment may be applied to the surface of the support.

The color photographic light-sensitive materials according to the present invention which are utilized to prepare color photographs are suitable for use as conventional color photographic materials, for example, color negative films, color paper, color reversal paper, and color reversal films, particularly color photographic light-sensitive materials for printing.

For development processing of the color photographic light-sensitive materials according to the present invention, a black-and-white developing solution and/or a color developing solution may be employed.

A example of a color developing solution which can be used is an alkaline aqueous solution containing preferably an aromatic primary amine type color developing agent as a main component. As the color developing agent, while an aminophenol type compound is useful, a p-phenylenediamine type compound is preferably employed. Typical examples of the p-phenylenediamine type compounds include 3-methyl-4-amino-N,N-diethylaniline, 3-methyl-4-amino-N-ethyl-N-β-hydroxyethylaniline, 3-methyl-4-amino-N-etyl-N-β-methansulfonamidoethylaniline, 3-methyl-4-amino-N-ethyl-N-β-methoxyethylaniline, or a sulfate, hydrochloride, or p-toluenesulfonate thereof.

Two or more kinds of color developing agents may be employed in a combination thereof, depending on the purpose.

The color developing solution can ordinarily contain pH buffering agents such as carbonates, borates or phosphates of alkali metals; and development inhibitors or anti-fogging agents such as bromides, iodides, benzimidazoles, benzothiazoles, or mercapto compounds. Further, if necessary, the color developing solution may contain various preservatives such as hydroxylamine, diethylhydroxylamine, sulfites, hydrazines, phenylsemicarbazides, triethanolamine, catechol sulfonic acids, or triethylenediamine(1,4-diazabicyclo[2,2,2]octane); organic solvents such as ethylene glycol, or diethylene glycol; development accelerators such as benzyl alcohol, polyethylene glycol, quarternay ammonium salts, or amines; dye forming couplers; competing couplers; fogging agents such as sodium borohydride; auxiliary developing agents such as 1-phenyl-3-pyrazolidone; viscosity imparting agents; and various chelating agents represented by aminopolycarboxylic acids, aminopolyphosphonic acids, alkylphosphonic acids, phosphonocarboxylic acids. Representative examples of the chelating agents include ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N',N'-tetramethylenephosphonic acid, ethylenediamine-di(o-hydroxyphenylacetic acid), and salts thereof.

In case of conducting reversal processing, color development is usually conducted after black-and-white development. In a black-and-white developing solution, known black-and-white developing agents, for example, dihydroxybenzenes such as hydroquinone, 3-pyrazolidones such as 1-phenyl-3-pyrazoldione, or aminophenols such as N-methyl-p-aminophenol may be employed individually or in combination.

The pH of the color developing solution or the black-and-white developing solution is usually in the range of from 9 to 12. Further, an amount of replenishment for the developing solution can be varied depending on the color photographic light-sensitive materials to be processed, but is generally not more than 3 liters per square meter of the photographic light-sensitive material. The amount of replenishment can be reduced to not more than 500 ml per square meter by decreasing the bromide ion concentration in the replenisher. In the case of reducing the amount of replenishment, it is preferred to prevent evaporation and aerial oxidation of the processing solution by means of reducing the area of the processing solution which is in contact with air. Further, the amount of replenishment can be reduced using a means which prevents accumulation of bromide ion in the developing solution.

After color development, the photographic emulsion layers are usually subjected to a bleach processing. The bleach processing can be performed simultaneously with a fix processing (bleach-fix processing), or it can be performed independently from the fix processing. Further, for the purpose of a rapid processing, a processing method wherein after a bleach processing a bleach-fix processing is conducted may be employed. Moreover, it may be appropriately practiced depending on the purpose to process using a continuous two tank bleach-fixing bath, to carry out fix processing before bleach-fix processing, or to conduct bleach processing after bleach-fix processing.

Examples of bleaching agents which can be employed in the bleach processing or bleach-fix processing include compounds of a multivalent metal such as iron(III), cobalt(III), chromium(VI), or copper(II); peracids; quinones; or nitro compounds. Representative examples of the bleaching agents include ferricyanides; dichloromates; organic complex salts of iron(III) or cobalt(III), for example, complex salts of aminopolycarboxylic acids (such as ethylenediaminetetraacetic acid, diethylenetriaminepentaacetic acid, cyclohexanediaminetetracetic acid, methyliminodiacetic acid, 1,3-diaminopropanetetraacetic acid, or glycol ether diaminetetraacetic acid), or complex salts of organic acids (such as citric acid, tartaric acid, or malic acid); persulfates; bromates; permanganates; or nitrobenzenes. Of these compounds, iron(III) complex salts of aminopolycarboxylic acids represented by iron (III) complex salt of ethylenediaminetetraacetic acid and persulfates are preferred in view of rapid processing and less environmental pollution. Furthermore, iron(III) complex salts of aminopolycarboxylic acids are particularly useful in both bleaching solutions and bleach-fixing solutions.

The pH of the bleaching solution or bleach-fixing solution containing an iron (III) complex salt of aminopolycarboxylic acid is usually in a range from 5.5 to 8. For the purpose of rapid processing, it is possible to process at a pH lower than the above described range.

In the bleaching solution, the bleach-fixing solution or a prebath thereof, a bleach accelerating agent can be used, if desired. Specific examples of suitable bleach accelerating agents include compounds having a mercapto group or a disulfide bond as described, for example, in U.S. Pat. No. 3,893,858, West German Patents 1,290,812 and 2,059,988, JP-A-53-32736, JP-A-53 57831, JP-A-53-37418, JP-A-53-72623, JP-A-53-95630, JP-A-53-95631, JP-A-53-104232, JP-A-53-124424, JP-A-53-141623, JP-A-53-28426, and *Research Disclosure,* No. 17129 (July 1978); thiazolidine derivatives as described, for example, in JP-A-50-140129; thiourea derivatives as described, for example, in JP-B-45-8506, JP-A-52-20832, JP-A-53-32735 and U.S. Patent 3,706,561; iodides as described, for example, in West German Patent 1,127,715 and JP-A-58-16235; polyoxyethylene compounds as described, for example, in West German Patents 966,410 and 2,748,430; polyamine compounds as described, for example, in JP-B-45-8836; compounds as described, for example, in JP-A-49 42434, JP-A-49-59644, JP-A-53-94927, JP-A-54-35727, JP-A-55-26506 and JP-A-58 163940; and bromide ions. Of these compounds, the compounds having a mercapto group or a disulfide bond are preferred in view of their large bleach accelerating effects. Particularly, the compounds as described in U.S. Pat. No. 3,893,858, West German Patent 1,290,812 and JP-A-53-95630 are preferred. Further, the compounds as described in U.S. Pat. No. 4,552,834 are also preferred. These bleach accelerating agents may be incorporated into the color photographic light-sensitive material. These bleach accelerating agents are particularly effectively employed when color photographic light-sensitive materials for photographing are subjected to bleach-fix processing.

As fixing agents which can be employed in the fixing solution or bleach-fixing solution, thiosulfates, thiocyanate, thioether compounds, thioureas, or a large amount of iodide are exemplified. Of these compounds, thiosulfates are generally employed. Particularly, ammonium thiosulfate is most widely employed. It is preferred to use sulfites, bisulfites or carbonylbisulfite adducts as preservatives in the bleach-fixing solution.

After a desilvering step, the silver halide color photographic material according to the present invention is generally subjected to a water washing step and/or a stabilizing step.

An amount of water required for the water washing step may be set in a wide range depending on characteristics of photographic light-sensitive materials (due to elements used therein, for example, couplers), uses thereof, temperature of the washing water, the number of water washing tanks (stages), the replenishment system such as countercurrent or orderly current, or other various conditions. A relationship between the number of water washing tanks and the amount of water in a multi-stage countercurrent system can be determined based on the method as described in *Journal of the Society of Motion Picture and Television Engineers,* Vol. 64, pages 248 to 253 (May, 1955).

According to the multi-stage countercurrent system described in the above literature, the amount of water for washing can be significantly reduced. However, increase in staying time of water in a tank causes propagation of bacteria and some problems, for example, adhesion of floatage on the photographic materials, occur. In the method of processing the silver halide color photographic material according to the present invention, a method for reducing amounts of calcium ions and magnesium ions as described in JP-A-62-288838 can be particularly effectively employed in order to solve such problems. Further, sterilizers, for example, isothiazolone compounds as described in JP-A-57-8542, thiabendazoles, chlorine type sterilizers such as sodium chloroisocyanurate, benzotriazoles, sterilizers as described in Hiroshi Horiguchi, *Bokin-Bobai No Kagaku,* published by Sankyo Shuppan, (1986), *Biseibutsu No Mekkin-, Sakkin-, Bobai-Gijutsu,* edited by Eiseigijutsu Kai, published by Kogyogijutsu Kai, (1982) and *Bokin-Bobaizai Jiten,* edited and published by Nippon Bokin-Bobai Gakkai (1986) can be employed.

The pH of the washing water used in the processing of the photographic light-sensitive materials according to the present invention is usually from 4 to 9, preferably from 5 to 8. Temperature of washing water and time for a water washing step can be adjusted depending on characteristics or uses of photographic light-sensitive materials. However, it is generally suitable to select a range of from 15° C. to 45° C. and a period from 20 sec. to 10 min. and preferably a range of from 25° C. to 40° C. and a period from 30 sec. to 5 min.

The photographic light-sensitive material of the present invention can also be directly processed with a stabilizing solution in place of the above-described water washing step. In such a stabilizing process, any of the known methods as described, for example, in JP-A-578543, JP-A-58-14834 and JP-A-60-220345 can be employed.

Further, it is possible to conduct the stabilizing process subsequent to the above-described water washing process. One example thereof is a stabilizing bath containing formulin and a surface active agent, which is employed as a final bath in the processing of color photographic light-sensitive materials for photographing. To such a stabilizing bath, various chelating agents and antimolds may also be added.

Overflow solutions resulting from replenishment for the above-described washing water and/or stabilizing solution may be reused in other steps such as a desilvering step.

For the purpose of simplification and acceleration of processing, a color developing agent may be incorporated into the silver halide color photographic material according to the present invention. In order to incorporate the color developing agent, it is preferred to employ various precursors of color developing agents. Suitable examples of the precursors of developing agents include indoaniline type compounds as described in U.S. Pat. Nos. 3,342,597, Schiff's base type compounds as described in U.S. Pat. No. 3,342,599 and *Research Disclosure,* No. 14850 and ibid. No. 15159, aldol compounds as described in *Research Disclosure,* No. 13924, metal salt complexes as described in U.S. Pat. No. 3,719,492, and urethane type compounds as described in JP-A-53-135628.

Further, the silver halide color photographic material according to the present invention may contain, if desired, various 1-phenyl-3-pyrazolidones for the purpose of accelerating color development. Typical examples of the compounds include those as described, for example, in JP-A-56-64339, JP-A-57-144547, and JP-A-58-115438.

In the present invention, various kinds of processing solutions can be employed in a temperature range from 10° C. to 50° C. Although a standard temperature is from 33° C. to 38° C., it is possible to carry out the processing at higher temperatures in order to accelerate the processing whereby the processing time is shortened, or at lower temperatures in order to achieve improvement in image quality and to maintain stability of the processing solutions.

Further, for the purpose of saving an amount of silver employed in the color photographic light-sensitive material, the photographic processing may be conducted utilizing color intensification using cobalt or hydrogen peroxide as described in West German Patent 2,226,770 or U.S. Pat. No. 3,674,499.

In accordance with the present invention, silver halide color photographic materials which provide cyan images having simultaneously improved fastness to heat, humidity and heat and light, which has been long sought after and the coating solutions thereof which have excellent stability, have now been obtained.

The present invention will be explained in greater detail with reference to the following examples, but the present invention should not be construed as being limited thereto.

EXAMPLE 1

Sample 101:

On a paper support, both surfaces of which were laminated with polyethylene, were coated layers as shown below in order to prepare a multilayer silver halide photographic material which was designated Sample 101. The coating solutions were prepared in the following manner.

Preparation of Coating Solution for First Layer:

19.1 g of Yellow Coupler (ExY), 4,40 g of discoloration inhibitor (Cpd-1) and 0.48 g of Image Stabilizer (Cpd-2) were dissolved in a mixture of 27.2 ml of ethyl acetate and 7.7 of Solvent (Solv-1) and the resulting solution was dispersed in 185 ml of a 10% aqueous solution of gelatin containing 8 ml of a 10% aqueous solution of sodium dodecylbenzenesulfonate. Separately, to a mixture of Silver Halide Emulsion (1) and Silver Halide Emulsion (2) was added $5.0\times10^{-4}$ mols of a blue-sensitive sensitizing dye shown below per mol of silver to prepare a blue-sensitive emulsion. The above described emulsified dispersion was mixed with the blue-sensitive silver halide emulsion, with the concentration of the resulting mixture being controlled, to form the composition shown below, i.e., the coating solution for the first layer.

Coating solutions for the second layer to the seventh layer were prepared in a similar manner as described for the coating solution for the first layer. 2-Oxy-3,5-dichloro-s-triazine sodium salt was used as a gelatin hardener in each layer.

Silver Halide Emulsion (1) used in the blue-sensitive emulsion layer according to the present invention was prepared in the following manner.

| | |
|---|---|
| Solution 1 | |
| $H_2O$ | 1,000 ml |
| NaCl | 5.5 g |
| Gelatin | 25 g |
| Solution 2 | |
| Sulfuric acid (1N) | 20 ml |
| Solution 3 | |
| A compound (1%) of the formula: | 2 ml |

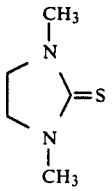

| | |
|---|---|
| Solution 4 | |
| KBr | 2.80 g |
| NaCl | 0.34 g |
| $H_2O$ to make | 140 ml |
| Solution 5 | |
| $AgNo_3$ | 5 g |
| $H_2O$ to make | 140 ml |
| Solution 6 | |
| KBr | 67.20 g |
| NaCl | 8.26 g |
| $K_2IrCl_6$ (0.001%) | 0.7 ml |
| $H_2O$ to make | 320 ml |
| Solution 7 | |
| $AgNO_3$ | 120 g |
| $NH_4NO_3$ (50%) | 2 ml |
| $H_2O$ to make | 320 ml |

Solution 1 was heated at 75° C., Solution 2 and Solution 3 were added thereto and then Solution 4 and Solution 5 were added simultaneously over a period of 9 minutes thereto. After 10 minutes, Solution 6 and Solution 7 were added simultaneously over a period of 45 minutes. After 5 minutes, the temperature was dropped and the mixture was desalted. Water and gelatin for dispersion were added thereto and pH was adjusted to 6.2 whereby a monodisperse cubic silver chlorobromide emulsion (having an average grain size of 1.01 μm, a coefficient of variation [a value obtained by dividing the standard deviation with the average grain size: s/d] of 0.08 and a silver bromide content of 80 mol %) was obtained. The emulsion was subjected to an optimum chemical sensitization using triethylthiourea, whereby Silver Halide Emulsion (1) was prepared.

Silver Halide Emulsion (2) used in the blue-sensitive emulsion layer, which was a monodispense cubic silver chlorobromide emulsion (having an average grain size of 0.65 μm, a coefficient of variation of 0.07 and a silver bromide content of 80 mol %) was prepared in the same manner as described above except changing the amounts of chemicals, temperature and time.

Silver Chlorobromide Emulsions (3), (4), (5) and (6) used in the green-sensitive emulsion layer and the red-sensitive emulsion layer, respectively, were prepared in the same manner as described above except changing the amounts of chemicals, temperature and time. Emulsions (3), (4), (5) and (6) are monodisperse cubic silver chlorobromide emulsions, and Emulsion (3) had an average grain size of 0.52 μm, a coefficient of variation of 0.08 and a silver bromide content of 80 mol %, Emulsion (4) had an average grain size of 0.40 μm, a coefficient of variation of 0.09 and a silver bromide content of 80 mol %, Emulsion (5) had an average grain size of 0.44 μm, a coefficient of variation of 0.09 and a silver bromide content of 70 mol %, and Emulsion (6) had an average grain size of 0.36 μm, a coefficient of variation of 0.08 and a silver bromide content of 70 mol %.

The following spectral sensitizing dyes were employed in the emulsion layers, respectively.

Blue Sensitive Emulsion Layer

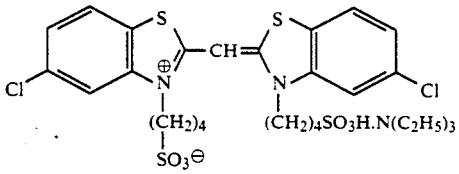

(Amount added: $5.0 \times 10^{-4}$ mol per mol of silver halide)

Green-Sensitive Emulsion Layer:

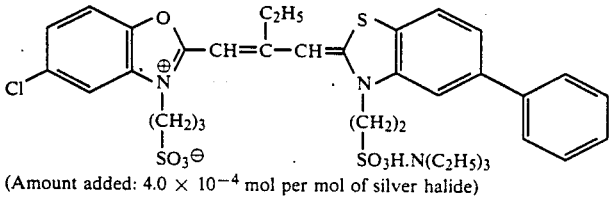

(Amount added: $4.0 \times 10^{-4}$ mol per mol of silver halide)

and

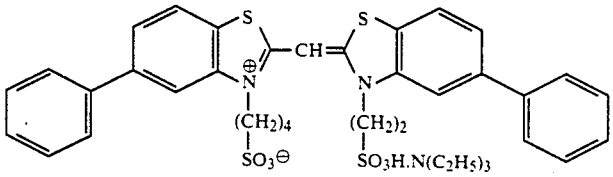

(Amount added: $7.0 \times 10^{-5}$ mol per mol of silver halide)

Red-Sensitive Emulsion Layer:

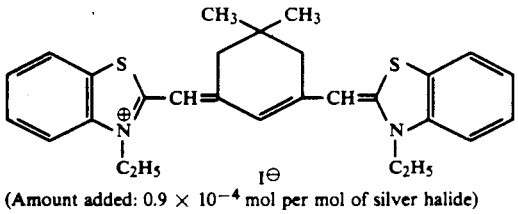

(Amount added: $0.9 \times 10^{-4}$ mol per mol of silver halide)

To the red-sensitive emulsion layer, was added the compound shown below in an amount of $2.6 \times 10^{-3}$ mol per mol of silver halide.

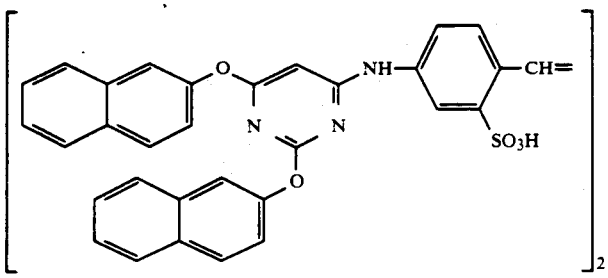

To the blue-sensitive emulsion layer and green-sensitive emulsion layer was added 4-hydroxy-6-methyl-1,3,3a,7-tetraazaindene in amounts of $1.2 \times 10^{-2}$ mol and $1.1 \times 10^{-2}$ mol per mol of silver halide, respectively.

Further, to the green-sensitive emulsion layer, was added 1-(5-methylureidophenyl)-5-mercaptotetrazole in an amount of $1.0 \times 10^{-3}$ mol per mol of silver halide.

Moreover, to the red-sensitive emulsion layer, was added 2-amino-5-mercapto-1,3,4-thiadiazole in an amount of $3.0 \times 10^{-4}$ mol per mol of silver halide.

Furthermore, as irradiation preventing dyes, the following dyes were employed.

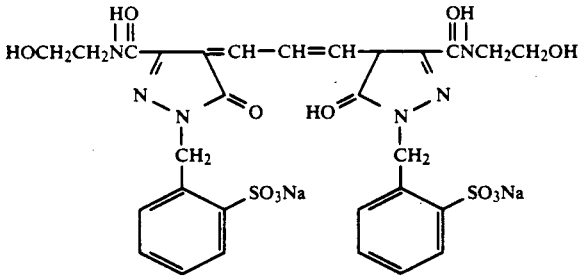

(ExD-1)

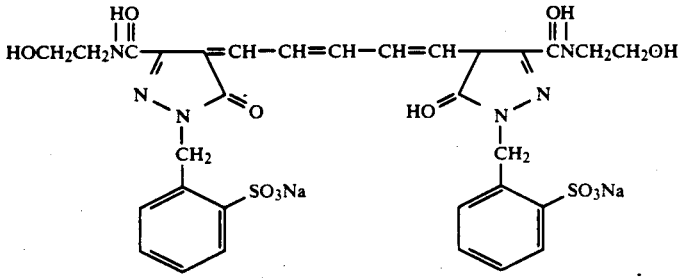

(ExD-2)

Layer Construction:

The composition of each layer is shown below. The numerical values denote the coating amounts of components in the unit of g/m². The coating amount of silver halide emulsion is indicated in terms of silver coating amount.

| | | |
|---|---|---|
| Support | Paper support, both surfaces of which were laminated with polyethylene (the polyethylene coating containing a white pigment ($TiO_2$) and a bluish dye (ultramarine) on the first layer side) | |
| First layer (Blue-sensitive layer) | Silver Halide Emulsions (1) and (2) | 0.26 |
| | Gelatin | 1.20 |
| | Yellow Coupler (ExY) | 0.66 |
| | Discoloration Inhibitor (Cpd-1) | 0.15 |
| | Color Image Stabilizer (Cpd-2) | 0.02 |
| | Solvent (Solv-1) | 0.13 |
| | Solvent (Solv-2) | 0.13 |
| Second Layer | Gelatin | 1.34 |
| (Color stain preventing | Color Stain Preventing Agent (Cpd-3) | 0.04 |
| | Solvent (Solv-3) | 0.09 |

-continued

| | | |
|---|---|---|
| layer) | Solvent (Solv-1) | 0.10 |
| Third Layer (Green-sensitive layer) | Silver Halide Emulsions (3) and (4) | 0.12 |
| | Gelatin | 1.28 |
| | Magenta Coupler (ExM) | 0.26 |
| | Color Image Stabilizer (Cpd-4) | 0.16 |
| | Anti-Staining Agent (Cpd-5) | 0.03 |
| | Anti-Staining Agent (Cpd-6) | 0.03 |
| | Solvent (Solv-3) | 0.21 |
| | Solvent (Solv-5) | 0.33 |
| Fourth Layer (Ultraviolet light Absorbing layer) | Gelatin | 1.44 |
| | Ultraviolet Light Absorbing Agent (UV-1) | 0.53 |
| | Color Image Stabilizer (Cpd-2) | 0.05 |
| | Solvent (Solv-2) | 0.26 |
| Fifth Layer (Red-sensitive layer) | Silver Halide Emulsions (5) and (6) | 0.20 |
| | Gelatin | 0.90 |
| | Cyan Coupler (C-28) | 0.29 |
| | Color Image Stabilizer (Cpd-2) | 0.01 |
| | Solvent (Solve-4) | 0.18 |
| Sixth Layer (Ultraviolet light Absorbing layer | Gelatin | 0.47 |
| | Ultraviolet Light Absorbing Agent (UV-1) | 0.17 |
| | Solvent (Solv-2) | 0.08 |
| Seventh Layer (Protective layer) | Gelatin | 1.25 |
| | Acryl-modified Polyvinyl Alcohol Copolymer (Degree of modification: 17%) | 0.05 |
| | Liquid Paraffin | 0.02 |

The compounds used in the above-described layers have the structures shown below respectively.

Yellow Coupler (ExY)

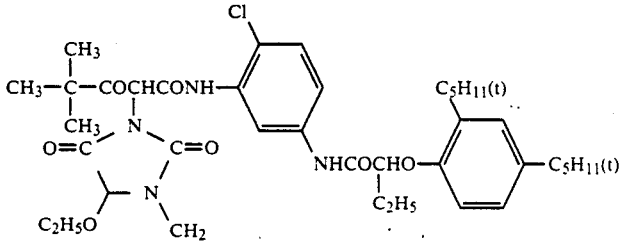

Magenta Coupler (ExM)

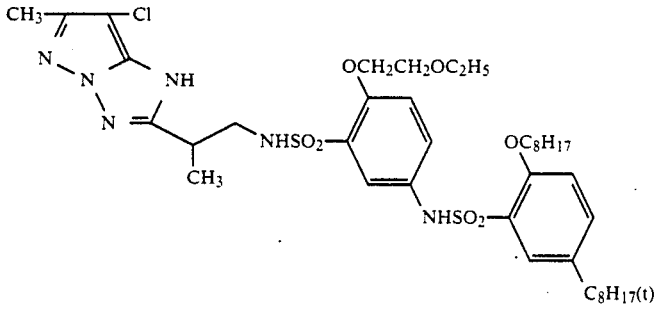

Discoloration Inhibitor (Cpd-1)

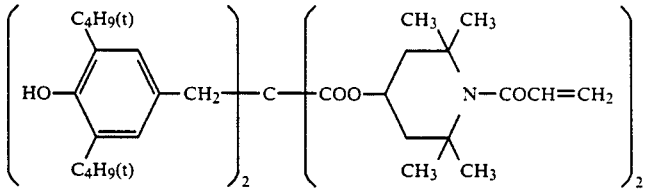

Color Image Stabilizer (Cpd-2)

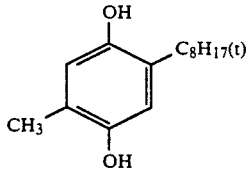

Color Stain Preventing Agent (Cpd-3)

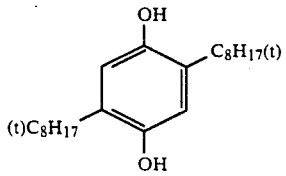

Color Image Stabilizer (Cpd-4)

-continued
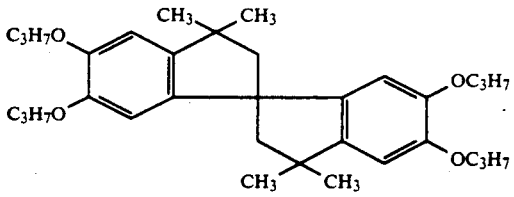
Anti-Staining Agent (Cpd-5)
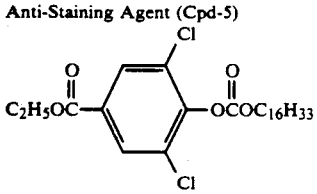
Anti-Staining Agent (Cpd-6)
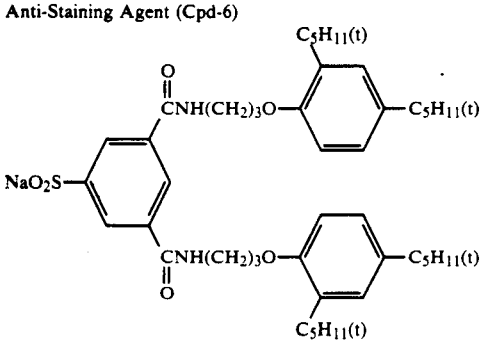
Ultraviolet Light Absorbing Agent (UV-1)
A mixture,
in a weight ratio of 12:10:3, of
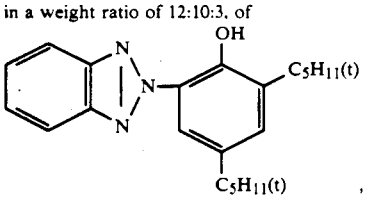
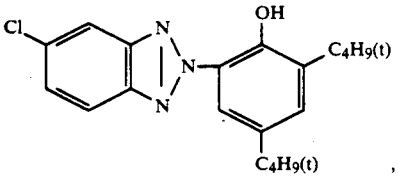
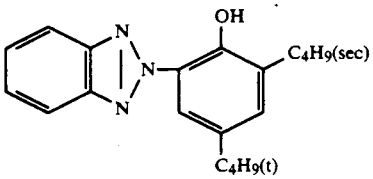
Solvent (Solv-1)
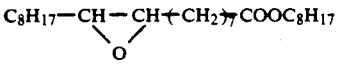
Solvent (Solv-2)
$O{=}P{\leftarrow}O{-}C_9H_{19}\text{-iso})_3$
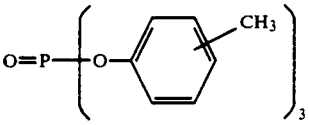

-continued

Solvent (Solv-4)

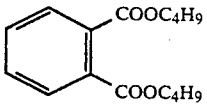

Solvent (Solv-5)

$$O{-}P{\leftarrow}O{-}\underset{}{\overset{C_2H_5}{\overset{|}{C}}}H_2{-}C_4H_9)_3$$

Samples 102 to 121:

In the same manner as described for Sample 101 except that the cyan coupler used in the fifth layer of Sample 101 was changed and the water-insoluble and organic solvent-soluble homopolymer or copolymer and the compound represented by the general formula (III) according to the present invention were added to the fifth layer as shown in Table 1 below to prepare Samples 102 to 118.

Further, Samples 119 to 121 were prepared except changing or removing the organic solvent having a high boiling point in the fifth layer as shown in Table 1 below.

In these samples, the amount of the water-insoluble and organic solvent-soluble homopolymer or copolymer added was 100% by weight to the cyan coupler.

TABLE 1

| | Fifth Layer | | | |
|---|---|---|---|---|
| Sample No. | Cyan Coupler | Poly-mer | Compound of General Formula (III) | High Boiling Coupler Solvent |
| (101) | C-28 | — | — | Solv-4 |
| (102) | C-29 | — | — | Solv-4 |
| (103) | C-12/C-28 | — | — | Solv-4 |
| (104) | C-30/C-45 | — | — | Solv-4 |
| (105) | C-2 | — | — | Solv-4 |
| (106) | C-28 | P-57 | — | Solv-4 |
| (107) | C-29 | P-3 | — | Solv-4 |
| (108) | C-12/C-28 | P-57 | — | Solv-4 |
| (109) | C-30/C-45 | P-21 | — | Solv-4 |
| (110) | C-2 | P-29 | — | Solv-4 |
| (111) | C-28 | P-57 | III-34 | Solv-4 |
| (112) | C-28 | P-57 | III-11 | Solv-4 |
| (113) | C-28 | P-57 | III-1/III-3/III-15 | Solv-4 |
| (114) | C-28 | P-57 | III-1/III-15/III-16 | Solv-4 |
| (115) | C-29 | P-3 | III-1/III-15/III-16 | Solv-4 |
| (116) | C-12/C-28 | P-57 | III-1/III-15/III-16 | Solv-4 |
| (117) | C-30/C-45 | P-21 | III-1/III-15/III-16 | Solv-4 |
| (118) | C-2 | P-29 | III-1/III-15/III-16 | Solv-4 |
| (119) | C-30/C-45 | P-57 | III-1/III-15/III-16 | Solv-1 |
| (120) | C-30/C-45 | P-57 | III-1/III-15/III-16 | — |
| (121) | C-30/C-45 | P-57 | III-11 | — |

In Table 1 above, the amount of cyan coupler used was the same by mole and when two cyan couplers were used the mixing ratio was 1:1 by mole. The amount of the compound (III) added was 25% by weight to the cyan coupler(s), and the mixing ratio of III-1/III-3/III-15 was 10:12:3 by weight and the mixing ratio of III-1/III-15/III-16 was 2:5:4 by weight.

Samples 101 to 1211 were exposed to light for sensitometry through a three-color separation filter using a sensitometer (FWH type manufactured by Fuji Photo Film Co., Ltd.) equipped with a light source of 3200° K. Then, the samples were subjected to development processing according to the following processing steps.

| Processing Step | Temperature | Time |
|---|---|---|
| Color Development | 33° C. | 3 min 30 sec |
| Bleach-Fixing | 33° C. | 1 min 30 sec |
| Washing with Water | 24 to 34° C. | 3 min |
| Drying | 70 to 80° C. | 1 min |

The composition of each processing solution used was as follows.

| Color Developing Solution: | |
|---|---|
| Water | 800 ml |
| Diethylenetriaminepentaacetic acid | 1.0 g |
| Nitrilotriacetic acid | 1.5 g |
| Benzyl alcohol | 15 ml |
| Diethylene glycol | 10 ml |
| Sodium sulfite | 2.0 g |
| Potassium bromide | 0.5 g |
| Potassium carbonate | 30 g |
| N-Ethyl-N-(β-methanesulfonamidoethyl)-3-methyl-4-aminoaniline sulfate | 5.0 g |
| Hydroxylamine sulfate | 4.0 g |
| Brightening agent (WHITEX 4B manufactured by Sumitomo Chemical Co., Ltd.) | 1.0 g |
| Water to make | 1000 ml |
| pH (25° C.) | 6.70 |

These samples thus processed were subjected to tests with respect to fastness of cyan color image.

Heat Fastness:

Fastness after being preserved at 100° C. in a dark place for 5 days.

Humidity and Heat Fastness:

Fastness after being preserved at 60° C. and 70% RH in a dark place for 4 months.

Light Fastness:

Fastness after being exposed to light in a xenon fading tester (100,000 lux) for 14 days.

The evaluation of fastness was conducted using a rate of decrease in density in an area having an initial density of 1.0. The result thus obtained are shown in Table 2 below.

Further, with respect to the coating solutions for the fifth layer, the dispersion stability of the solution during preservation prior to coating was investigated. More specifically, the coating solutions prepared were allowed to stand for 72 hours while maintaining the temperature at 40° C., then filtered using a porefilter of 3 μm to measure the degree of choke, thereby the dispersion stability during preservation was evaluated. The results are also shown in Table 2 below, where ○ indicates "good", Δ indicates "fair" and x indicates "poor".

TABLE 2

| Sample No. | Heat Fastness (%) | Humidity and Heat Fastness (%) | Light Fastness (%) | Dispersion Stability during Preservation | Remark |
|---|---|---|---|---|---|
| (101) | 55 | 30 | 25 | X | Comparison |
| (102) | 25 | 8 | 30 | X | " |
| (103) | 20 | 20 | 29 | Δ | " |
| (104) | 24 | 9 | 28 | Δ | " |
| (105) | 9 | 6 | 26 | X | " |
| (106) | 13 | 12 | 13 | X | " |
| (107) | 10 | 4 | 21 | X | " |
| (108) | 10 | 12 | 17 | Δ | " |
| (109) | 8 | 10 | 18 | Δ | " |
| (110) | 5 | 3 | 18 | X | " |
| (111) | 10 | 8 | 10 | ○ | Invention |
| (112) | 9 | 8 | 9 | ○ | " |
| (113) | 10 | 9 | 10 | ○ | " |
| (114) | 10 | 9 | 10 | ○ | " |
| (115) | 8 | 3 | 16 | ○ | " |
| (116) | 8 | 10 | 13 | ○ | " |
| (117) | 6 | 8 | 13 | ○ | " |
| (118) | 5 | 3 | 14 | ○ | " |
| (119) | 7 | 9 | 13 | ○ | " |
| (120) | 5 | 3 | 10 | ○ | " |
| (121) | 5 | 3 | 9 | ○ | " |

As is apparent from the results shown in Table 2, it is recognized that heat fastness, humidity and heat fastness and light fastness are individually improved to some extend by the coexistence of the water-insoluble and organic solvent-soluble homopolymer or copolymer according to the present invention, although there is no effect on improvement in the stability of the coating solution during preservation. On the contrary, it can be seen the the further coexistence of the compound represented by the general formula (III) according to the embodiment of the present invention achieves a remarkable improvement in stability during preservation as well as further improvement in fastness.

EXAMPLE 2

Sample 201

On a paper support, both surfaces of which were laminated with polyethylene, were coated layers as shown below in order to prepare a multilayer silver halide photographic material which was designated Sample 201.

The silver halide emulsions employed were monodisperse cubic silver halide emulsions shown below which were prepared in the same manner as described in Example 1 except changing the amount of chemicals, temperature and time.

Silver Halide Emulsion (7):

Average grain size: 0.85 μm, coefficient of variation: 0.10, silver bromide content: 0.6 mol %

Silver Halide Emulsion (8):

Average grain size: 0.45 μm, coefficient of variation: 0.09, silver bromide content: 1.0 mol %

Silver Halide Emulsion (9):

Average grain size: 0.34 μm, coefficient of variation: 0.10, silver bromide content: 1.8 mol %

The following spectral sensitizing dyes were employed in the emulsion layers, respectively.

Blue-Sensitive Emulsion Layer:

Same as described in Example 1

Green-Sensitive Emulsion Layer:

Same as described in Example 1

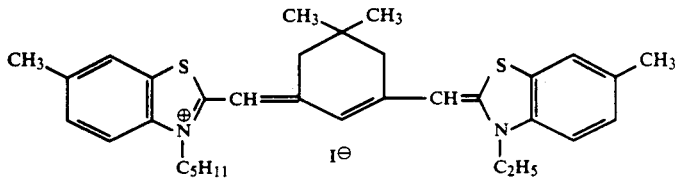

To the red-sensitive emulsion layer, was added the compound shown below in an amount of $1.5\times10^{-3}$ mol per mol of silver halide.

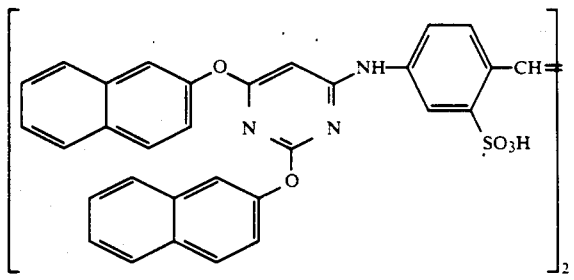

Further, to the blue sensitive emulsion layer, was added 4-hydroxy-6-methyl-1,3,3a,7-tetraazaindene in amount of $1.0\times10^{-2}$ mol per mol of silver halide.

Moreover, to the blue-sensitive emulsion layer, green-sensitive emulsion layer and red-sensitive emulsion layer, was added 1-(5-methylureidophenyl)-5-mercaptotetrazole in amounts of $1.0\times10^{-3}$ mol, $5.0\times10^{-3}$ mol and $5.0\times10^{-3}$ mol per mol of silver halide, respectively.

Furthermore, as irradiation preventing dyes, the following dyes were employed.

(ExD-2)

Same as described in Example 1.

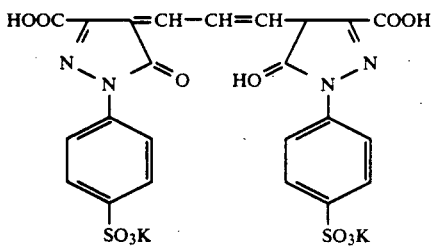

(ExD-3)

As a gelatin hardener in each layer, 2-oxy-3,5-dichloro-s-triazine sodium salt was used.

Layer Construction:

The composition of each layer is shown below. The numerical values denote the coating amounts of components in the unit of g/m². The coating amount of silver halide emulsion is indicated in terms of silver coating amount.

| | | |
|---|---|---|
| Support | Paper support, both surfaces of which were laminated with polyethylene (the polyethylene coating containing a white pigment ($TiO_2$) and a bluish dye (ultramarine) on the first layer side) | |
| First layer (Blue-sensitive layer) | Silver Halide Emulsion (7) | 0.27 |
| | Gelatin | 1.86 |
| | Yellow Coupler (ExY) | 0.82 |
| | Solvent (Solv-4) | 0.35 |
| Second Layer (Color stain preventing layer) | Gelatin | 0.90 |
| | Color Stain Preventing Agent (Cpd-3) | 0.06 |
| | Solvent (Solv-3) | 0.06 |
| | Solvent (Solv-4) | 0.06 |
| Third Layer (Green-sensitive layer) | Silver Halide Emulsion (8) | 0.45 |
| | Gelatin | 1.24 |
| | Magenta Coupler (M-17) | 0.35 |
| | Color Image Stabilizer (Cpd-4) | 0.12 |
| | Color Image Stabilizer (Cpd-7) | 0.06 |
| | Color Image Stabilizer (Cpd-8) | 0.10 |
| | Color Image Stabilizer (Cpd-9) | 0.01 |
| | Solvent (Solv-3) | 0.25 |
| | Solvent (Solv-5) | 0.25 |
| Fourth Layer (Ultraviolet light Absorbing layer) | Gelatin | 1.60 |
| | Ultraviolet Light Absorbing Agent (UV-1) | 0.70 |
| | Color Image Stabilizer (Cpd 2) | 0.05 |
| | Solvent (Solv-2) | 0.42 |
| Fifth Layer (Red-sensitive layer) | Silver Halide Emulsion (9) | 0.20 |
| | Gelatin | 0.92 |
| | Cyan Coupler (C-28) | 0.29 |
| | Color Image Stabilizer (Cpd-2) | 0.02 |
| | Solvent (Solve-4) | 0.20 |
| Sixth Layer (Ultraviolet light Absorbing layer) | Gelatin | 0.54 |
| | Ultraviolet Light Absorbing Agent (UV-1) | 0.21 |
| | Solvent (Solve-2) | 0.08 |
| Seventh Layer (Protective layer) | Gelatin | 1.33 |
| | Acryl-modified Polyvinyl Alcohol Copolymer (Degree of modification: 17%) | 0.17 |
| | Liquid Paraffin | 0.03 |

The compounds used in the above-described layers other than those described in Example 1 have the structures shown below respectively.

Color Image Stabilizer (Cpd-7)

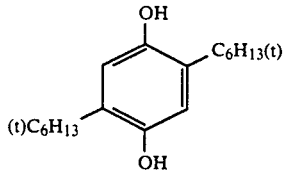

Color Image Stabilizer (Cpd-8)

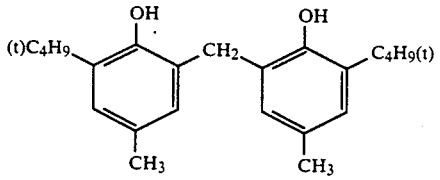

Color Image Stabilizer (Cpd-9)

-continued

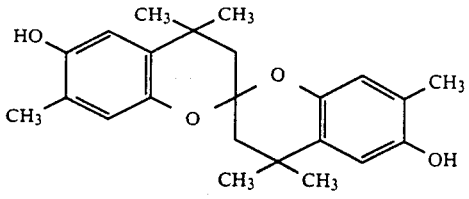

Samples 202 to 216:

Samples 202 to 216 were prepared in the same manner as described for Sample 201 except changing the cyan coupler used in the fifth layer of Sample 201, adding the water-insoluble and organic solvent soluble homopolymer or copolymer and the compound represented by the general formula (III) according to the present invention, and further changing or removing the organic solvent having a high boiling point as shown in Table 3 below.

TABLE 3

| | Fifth Layer | | | |
|---|---|---|---|---|
| Sample No. | Cyan Coupler | Polymer | Compound of General Formula (III) | Solvent |
| (201) | C-28 | — | — | Solv-4 |
| (202) | C-29 | — | — | Solv-4 |
| (203) | C-12/C-28 | — | — | Solv-4 |
| (204) | C-28 | P-57 | — | Solv-4 |
| (205) | C-29 | P-3 | — | Solv-4 |
| (206) | C-12/C-28 | P-57 | — | Solv-4 |
| (207) | C-28 | P-57 | III-34 | Solv-4 |
| (208) | C-28 | P-57 | III-11 | Solv-4 |
| (209) | C-28 | P-57 | III-1/III-3/III-15 | Solv-4 |
| (210) | C-28 | P-57 | III-1/III-15/III-16 | Solv-4 |
| (211) | C-29 | P-3 | III-1/III-15/III-16 | Solv-4 |
| (212) | C-12/C-28 | P-57 | III-1/III-15/III-16 | Solv-4 |
| (213) | C-30/C-45 | P-21 | III-1/III-15/III-16 | Solv-4 |
| (214) | C-2 | P-29 | III-1/III-15/III-16 | Solv-4 |
| (215) | C-28 | P-57 | III-1/III-15/III-16 | Solv-6 |
| (216) | C-30/C-45 | P-57 | III-1/III-15/III-16 | — |

In Table 3 above, the amount of the cyan coupler used was the same by mole and the mixing ration thereof was 1:1 by mole. The amount of the compound (III) added was 25% by weight of the cyan coupler, and the mixing ratio of III-1/III-3/III-15 was 10:12:3 by weight and the mixing ratio of III-1/III-15/III-16 was 2:5:4 by weight.

Solvent (Solv-6)

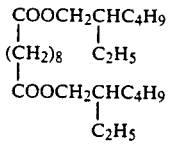

Samples 201 to 216 were exposed to light for sensitometric analysis in the same manner as described in Example 1. Then, the samples were subjected to development processing according to the following processing steps.

| Processing Step | Temperature | Time |
|---|---|---|
| Color Development | 35° C. | 45 sec |
| Bleach-Fixing | 30 to 36° C. | 45 sec |
| Stabilizing (1) | 30 to 37° C. | 20 sec |
| Stabilizing (2) | 30 to 37° C. | 20 sec |
| Stabilizing (3) | 30 to 37° C. | 20 sec |
| Stabilizing (4) | 30 to 37° C. | 30 sec |

-continued

| Processing Step | Temperature | Time |
|---|---|---|
| Drying | 70 to 85° C. | 60 sec |

The stabilizing steps were conducted using a four-tank countercurrent system wherein the direction of flow was from Stabilizing (4) to Stabilizing (1).

The composition of each processing solution used was as follows:

| | Tank Solution |
|---|---|
| Color Developing Solution: | |
| Water | 800 ml |
| Etylenediaminetetraacetic acid | 2.0 g |
| Triethanolamine | 8.0 g |
| Sodium chloride | 1.4 g |
| Potassium carbonate | 25 g |
| N-Ethyl-N-(β-methanesulfonamidoethyl)-3-methyl-4-aminoaniline sulfate | 5.0 g |
| N,N-Diethylhydroxylamine | 4.2 g |
| 5,6-Dihydroxybenzene-1,2,4-trisulfonic acid | 0.3 g |
| Brightening agent (4,4'-diaminostilbene type) | 2.0 g |
| Water to make | 1000 ml |
| pH (25° C.) | 10.10 |
| Bleach-Fixing Solution | |
| Water | 400 ml |
| Ammonium thiosulfate (70%) | 100 ml |
| Sodium sulfite | 18 g |
| Ammonium ethylenediaminetetraacetato ferrate | 55 g |
| Disodium ethylenediaminetetraacetate | 3 g |
| Glacial acetic acid | 8 g |
| Water to make | 1000 ml |
| pH (25° C.) | 5.5 |
| Stabilizing Solution: | |
| Formaldehyde (37%) | 0.1 g |
| Formaldehyde-sulfite adduct | 0.7 g |
| 5-chloro-2-methyl-4-isothiazolin-3-one | 0.02 g |
| 2-Methyl-4-isothiazolin-3-one | 0.01 g |
| Cupric sulfate | 0.005 g |
| Water to | 1000 ml |
| pH (25° C.) | 4.0 |

With these samples thus processed, the fastness of cyan color image and the stability of the coating solution during preservation were determined in the same manner as described in Example 1. The results are shown in Table 4 below.

TABLE 4

| Sample No. | Heat Fastness (%) | Humidity and Heat Fastness (%) | Light Fastness (%) | Dispersion Stability during Preservation | Remark |
|---|---|---|---|---|---|
| (201) | 50 | 30 | 29 | X | Comparison |
| (202) | 25 | 8 | 32 | X | " |
| (203) | 20 | 20 | 30 | Δ | " |
| (204) | 18 | 13 | 18 | X | " |
| (205) | 15 | 6 | 25 | X | " |
| (206) | 13 | 12 | 19 | Δ | " |
| (207) | 12 | 9 | 11 | ○ | Invention |
| (208) | 10 | 9 | 10 | ○ | " |
| (209) | 11 | 10 | 13 | ○ | " |
| (210) | 11 | 10 | 13 | ○ | " |
| (211) | 10 | 4 | 17 | ○ | " |
| (212) | 10 | 11 | 15 | ○ | " |
| (213) | 8 | 9 | 15 | ○ | " |
| (214) | 8 | 5 | 17 | ○ | " |
| (215) | 12 | 10 | 15 | ○ | " |
| (216) | 8 | 8 | 10 | ○ | " |

As is apparent from the results shown in Table 4 above, the effect on remarkable improvement with respect to the stability of the coating solution and the fastness to heat, humidity and heat, and light is achieved similar to Example 1.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising a support having thereon a cyan coupler-containing layer, a magenta coupler-containing layer and a yellow coupler-containing layer, wherein the cyan coupler-containing layer contains a dispersion of oleophilic fine particles which is obtained by emulsifying or dispersing a solution containing (a) at least one cyan coupler represented by the general formula (I) and/or (II) described below, (b) at least one compound represented by the general formula (III) described below, (c) at least one water-insoluble and organic solvent-soluble homopolymer or copolymer, and (d) an organic solvent having a boiling point of not less than 160° C.,

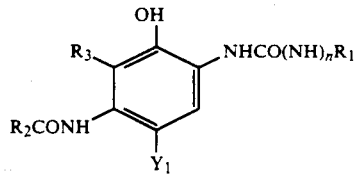

(I)

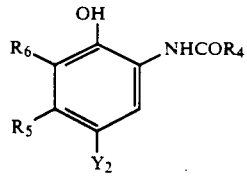

(II)

wherein $R_1$, $R_2$, and $R_4$ each represents a substituted or unsubstituted aliphatic group, a substituted or unsubstituted aromatic group or a substituted or unsubstituted heterocyclic group, $R_3$, $R_5$ and $R_6$ each represents a hydrogen atom, a halogen atom, an aliphatic group, an aromatic group or an acylamino group, and $R_3$ may represent a non-metallic atomic group necessary to form a nitrogen-containing 5-membered or 6-membered ring together with $R_2$, $Y_1$ and $Y_2$ each represents a hydrogen atom or a group capable of being released upon a coupling reaction with an oxidation product of a developing agent, and n represents 0 or 1,

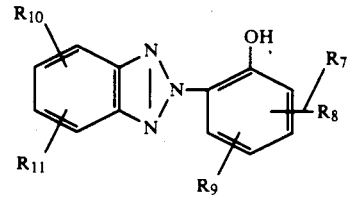

(III)

wherein $R_7$, $R_8$, $R_9$, $R_{10}$ and $R_{11}$, which may be the same or different, each represents a hydrogen atom, a halogen atom, a nitro group, a hydroxy group, an alkyl group, an alkenyl group, an aryl group, an alkoxy group, an acyloxy group, an aryloxy group, an alkylthio group, an arylthio group, a mono- or di-alkylamino group, an acylamino group or a 5-membered or 6-membered heterocyclic group containing an oxygen atom or a nitrogen atom, and $R_{10}$ and $R_{11}$ may combine with each other to form a 5-membered or 6-membered aromatic ring.

2. A silver halide color photographic material as claimed in claim 1, wherein the aliphatic group represented by $R_1$, $R_2$ or $R_4$ is an aliphatic group having from 1 to 32 carbon atoms.

3. A silver halide color photographic material as claimed in claim 1, wherein a substituent for the aliphatic group, the aryl group or the heterocyclic group represented by $R_1$, $R_2$ or $R_4$ is selected from an alkyl group, an aryl group, a heterocyclic group, an alkoxy group, an aryloxy group, an alkenyloxy group, an acyl group, an ester group, an amido group, a carbamoyl group, a sulfamoyl group, an imido group, a ureido group, an aliphatic or aromatic sulfonyl group, an aliphatic or aromatic thio group, a hydroxy group, a cyano group, a carboxy group, a nitro group, a sulfo group and a halogen atom.

4. A silver halide color photographic material as claimed in claim 1 wherein $R_5$ represents an aliphatic group.

5. A silver halide color photographic material as claimed in claim 1, wherein the group capable of being released upon coupling represented by $Y_1$ or $Y_2$ is a halogen atom, an alkoxy group, an aryloxy group, an acyloxy group, a sulfonyloxy group, an amido group, an alkoxycarbonyloxy group, an aryloxycarbonyloxy group, an aliphatic or aromatic thio group, an imido group or an aromatic azo group.

6. A silver halide color photographic material as claimed in claim 1, wherein $R_1$ is a substituted or unsubstituted aryl group or a substituted or unsubstituted heterocyclic group.

7. A silver halide color photographic material as claimed in claim 6, wherein $R_1$ is an aryl group substituted with one or more substituents selected from a halogen atom, an alkyl group, an alkoxy group, an aryloxy group, an acylamino group, an acyl group, a carbamoyl group, a sulfonamido group, a sulfamoyl group, a sulfonyl group, a sulfamido group, an oxycarbonyl group and a cyano group.

8. A silver halide color photographic material as claimed in claim 1, wherein $R_2$ is a substituted or unsubstituted alkyl group or a substituted or unsubstituted aryl group.

9. A silver halide color photographic material as claimed in claim 8, wherein $R_2$ is an alkyl group substituted with a substituted aryloxy group.

10. A silver halide color photographic material as claimed in claim 1, wherein $R_3$ is a hydrogen atom.

11. A silver halide color photographic material as claimed in claim 1, wherein $R_4$ is a substituted or unsubstituted alkyl group or a substituted or unsubstituted aryl group.

12. A silver halide color photographic material as claimed in claim 11, wherein $R_4$ is an aryl group substituted with a substituted aryloxy group.

13. A silver halide color photographic material as claimed in claim 1, wherein $R_5$ is an alkyl group having from 1 to 15 carbon atoms.

14. A silver halide color photographic material as claimed in claim 13, wherein $R_5$ is an alkyl group having from 2 to 4 carbon atoms.

15. A silver halide color photographic material as claimed in claim 1, wherein $R_6$ is a hydrogen atom or a halogen atom.

16. A silver halide color photographic material as claimed in claim 1, wherein $R_6$ is a chlorine atom or a fluorine atom.

17. A silver halide color photographic material as claimed in claim 1, wherein $Y_1$ and $Y_2$ each represents a hydrogen atom, a halogen atom, an alkoxy group, an aryloxy group, an acyloxy group or a sulfonamido group.

18. A silver halide color photographic material as claimed in claim 17, wherein $Y_2$ is a halogen atom.

19. A silver halide color photographic material as claimed in claim 18, wherein $Y_2$ is chlorine atom or fluorine atom.

20. A silver halide color photographic material as claimed in claim 1, wherein n is 0, and $Y_1$ is a halogen atom.

21. A silver halide color photographic material as claimed in claim 20, wherein $Y_1$ is a chlorine atom or a fluorine atom.

22. A silver halide color photographic material as claimed in claim 1, wherein the water-insoluble and organic solvent-soluble homopolymer or copolymer is composed of a repeating unit having a linkage of

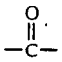

in the main chain or side chain thereof.

23. A silver halide color photographic material as claimed in claim 22, wherein the homopolymer or copolymer is composed of a repeating unit having a linkage of

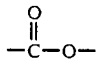

in the main chain or side chain thereof.

24. A silver halide color photographic material as claimed in claim 22, wherein the homopolymer or copolymer is composed of a repeating unit having a group of

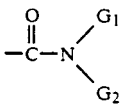

(wherein $G_1$ and $G_2$, each represents a hydrogen atom, a substituted or unsubstituted alkyl group or a substituted or unsubstituted aryl group, provided that both $G_1$ and $G_2$ are not hydrogen atoms at the same time) in the side chain thereof.

25. A silver halide color photographic material as claimed in claim 24, wherein one of $G_1$ and $G_2$ is a hydrogen atom and the other is a substituted or unsubstituted alkyl group or a substituted or unsubstituted aryl group each having from 3 to 12 carbon atoms.

26. A silver halide color photographic material as claimed in claim 1, wherein the homopolymer or copolymer is a vinyl polymer composed of a monomer selected from an acrylic acid ester, a methacrylic acid ester, a vinyl ester, an acrylamide, a methacrylamide, an olefin, a styrene, a vinyl ether and other vinyl monomers.

27. A silver halide color photographic material as claimed in claim 1, wherein the homopolymer or copolymer is a polyester obtained by condensation of a polyhydric alcohol and a polybasic acid.

28. A silver halide color photographic material as claimed in claim 1, wherein the homopolymer or copolymer is a polyester obtained by condensation of a diamine and a dibasic acid or a ω-amino-ω-carboxylic acid.

29. A silver halide color photographic material as claimed in claim 1, wherein the homopolymer or copolymer is a polyurethane obtained by polyaddition of a diisocyanate and a dihydric alcohol.

30. A silver halide color photographic material as claimed in claim 1, wherein the homopolymer or copolymer is a polyester or a polyamide having a repeating unit of

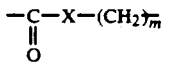

wherein X represents —O— or —NH—; m represents an integer from 4 to 7; and the —$CH_2$— chain may be a branched chain.

31. A silver halide color photographic material as claimed in claim 1, wherein the compound represented by the general formula (III) is a compound represented by the following general formula (IV):

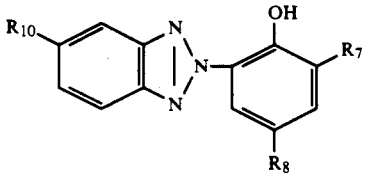

(IV)

wherein $R_7$ and $R_8$ each has the same meaning as defined in the general formula (III); and $R_{10}$ represents a hydrogen atom, a halogen atom, an alkyl group, an alkoxy group, an aryl group or an aryloxy group each has the same meaning as defined in the general formula (III).

32. A silver halide color photographic material as claimed in claim 31, wherein $R_{10}$ represents a hydrogen atom or a halogen atom.

33. A silver halide color photographic material as claimed in claim 1, wherein an amount of the compound represented by the general formula (III) is in a range from $1\times10^{-4}$ mol/m$^2$ to $2\times10^{-3}$ mol/m$^2$ of the color photographic material.

34. A silver halide color photographic material as claimed in claim 1, wherein the cyan coupler-containing layer is a red-sensitive silver halide emulsion layer, the magenta coupler-containing layer is a green-sensitive silver halide emulsion layer and the yellow coupler-containing layer is a blue-sensitive silver halide emulsion layer.

35. A silver halide color photographic material as claimed in claim 1, wherein silver halide in the silver halide emulsion layers is silver chlorobromide.

36. A silver halide color photographic material as claimed in claim 1, wherein silver halide grains in the silver halide emulsion have a coefficient of variation of diameter not more than 15%.

37. A silver halide color photographic material as claimed in claim 1, wherein the yellow coupler is a compound represented by the following general formula (Y-1) or (Y-2);

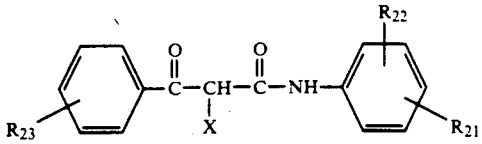

(Y-1)

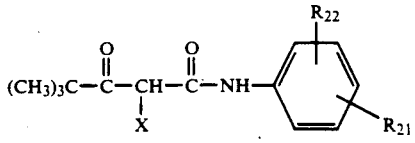

(Y-2)

wherein X represents a hydrogen atom or a group capable of being released upon compling; $R_{21}$ represents a diffusion resistant group having from 8 to 32 carbon atoms in total; $R_{22}$ represents a hydrogen atom, one or more of halogen atoms, lower alkyl groups, lower alkoxy groups or diffusion resistant groups having from 8 to 32 carbon atoms in total; and $R_{23}$ represents a hydrogen atom or a substituent, when two or more $R_{23}$'s are present, they may be the same or different.

38. A silver halide color photographic material as claimed in claim 36, wherein the magenta couple is a compound represented by the following general formula (M-1), (M-2) or (M-3):

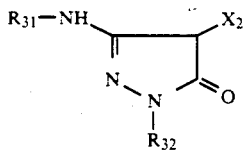

(M-1)

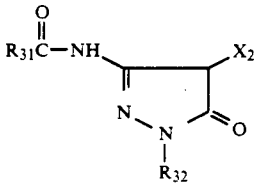

(M-2)

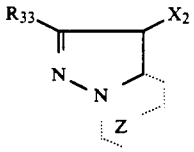

(M-3)

wherein $R_{31}$ represents a diffusion resistant group having from 8 to 32 carbon atoms in total; $R_{32}$ represents a phenyl group or a substituted phenyl group; $R_{33}$ represents a hydrogen atom or a substituent; Z represents a nonmetallic atomic group necessary to form a 5-membered azole ring containing two to four nitrogen atoms, which azole ring may have one or more substituents (including a condensed ring); and $X_2$ represents a hydrogen atom or a group capable of being released.

39. A silver halide color photographic material as claimed in claim 1, wherein the organic solvent having a high boiling point is a compound represented by the following general formula (V), (VI), (VII), (VIII), (IX) or (X):

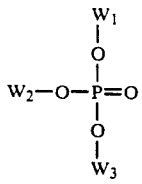

(V)

$W_1—COOW_2$ (VI)

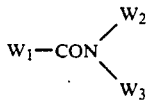

(VII)

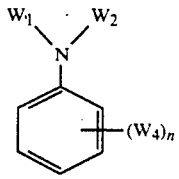

(VIII)

-continued $W_1—O—W_2$ (IX)

$HO—W_5$ (X)

wherein $W_1$, $W_2$ and $W_3$ each represents a substituted or unsubstituted alkyl group, a substituted or unsubstituted cycloalkyl group, a substituted or unsubstituted alkenyl group, a substituted or unsubstituted aryl group or a substituted or unsubstituted heterocyclic group; $W_4$ represents $W_1$, —O—$W_1$ or —S—$W_1$; n represents an integer from 1 to 5 and when n is two or more, two or more $W_4$'s may be the same or different; $W_1$ and $W_2$ in the general formula (IX) may combine with each other to form a condensed ring; $W_5$ represents a substituted or unsubstituted alkyl group or a substituted or unsubstituted aryl group and the total number of carbon atoms included in $W_5$ is not less than 12.

40. A silver halide color photographic material as claimed in claim 1, wherein the oleophilic fine particles have an average particle size of from 0.04 μm to 2 μm.

41. A silver halide color photographic material as claimed in claim 34, wherein said silver halide emulsion layers each contains a silver chlorobromide emulsion having 90 mol % or more of silver chloride content.

* * * * *